US010538869B2

(12) United States Patent
Suzuki et al.

(10) Patent No.: US 10,538,869 B2
(45) Date of Patent: Jan. 21, 2020

(54) SEWING MACHINE

(71) Applicant: BROTHER KOGYO KABUSHIKI KAISHA, Nagoya-shi, Aichi-ken (JP)

(72) Inventors: Yasunori Suzuki, Nagoya (JP); Hirokazu Hirose, Chiryu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 57 days.

(21) Appl. No.: 15/995,951

(22) Filed: Jun. 1, 2018

(65) Prior Publication Data

US 2018/0274147 A1 Sep. 27, 2018

Related U.S. Application Data

(63) Continuation of application No. PCT/JP2016/084240, filed on Nov. 18, 2016.

(30) Foreign Application Priority Data

Dec. 23, 2015 (JP) ..... 2015-250746

(51) Int. Cl.
*D05B 47/04* (2006.01)

(52) U.S. Cl.
CPC ..... *D05B 47/04* (2013.01)

(58) Field of Classification Search
CPC ..... D05B 87/00; D05B 87/02; D05B 87/04; D05B 47/04; D05B 47/06; D05B 19/12
See application file for complete search history.

(56) References Cited

U.S. PATENT DOCUMENTS 4,328,757 A * 5/1982 Inaba ..... D05B 47/06 112/278
4,702,185 A * 10/1987 Hanyu ..... D05B 47/04 112/254

(Continued)

FOREIGN PATENT DOCUMENTS

JP 2002-113274 A 4/2002
JP 2006-141869 A 6/2006

(Continued)

OTHER PUBLICATIONS

Jun. 26, 2018 International Preliminary Report on Patentability issued in International Patent Application PCT/JP2016/084240.

(Continued)

*Primary Examiner* — Nathan E Durham
(74) *Attorney, Agent, or Firm* — Oliff PLC

(57) ABSTRACT

A sewing machine includes a thread tension mechanism, a thread feed sensor, a sewing portion, a processor, and a memory. By executing instructions stored in the memory, the processor causes a first tension to act on an upper thread by the thread tension mechanism to be in a first state, in a state in which a sewing is stopped. The processor causes a second tension that is smaller than the first tension to act on the upper thread, by causing the thread tension mechanism to be in a second state, when the movement of the upper thread is detected by the thread feed sensor. The processor causes a third tension that is equal to or greater than the second tension to act on the upper thread by causing the thread tension mechanism to be in a third state, in a state in which the sewing is performed.

7 Claims, 11 Drawing Sheets

(56) References Cited

U.S. PATENT DOCUMENTS

| | | | | |
|---|---|---|---|---|
| 4,873,931 | A * | 10/1989 | Takagi | D05B 47/04 112/470.01 |
| 6,012,405 | A * | 1/2000 | Melton | D05B 19/12 112/254 |
| 6,701,858 | B2 * | 3/2004 | Wacker | D05B 87/02 112/225 |
| 2006/0107883 | A1 * | 5/2006 | Terao | D05B 19/12 112/237 |
| 2006/0118017 | A1 * | 6/2006 | Watanabe | D05B 87/02 112/225 |
| 2007/0186831 | A1 | 8/2007 | Shimizu | |
| 2007/0204781 | A1 | 9/2007 | Noguchi | |
| 2010/0199902 | A1 * | 8/2010 | Mori | D05B 19/12 112/456 |
| 2012/0006241 | A1 | 1/2012 | Nishiyama et al. | |

FOREIGN PATENT DOCUMENTS

| | | | |
|---|---|---|---|
| JP | 2007-215734 | A | 8/2007 |
| JP | 2007-229291 | A | 9/2007 |
| WO | 2010/109773 | A1 | 9/2010 |

OTHER PUBLICATIONS

Jan. 24, 2017 International Search Report issued in International Patent Application No. PCT/JP2016/084240.

* cited by examiner

SEWING MACHINE

CROSS-REFERENCE TO RELATED APPLICATION

This application is a Continuation Application of International Application No. PCT/JP2016/084240, filed Nov. 18, 2016, which claims priority from Japanese Patent Application No. 2015-250746, filed on Dec. 23, 2015. This disclosure of the foregoing application is hereby incorporated by reference in its entirety.

BACKGROUND

The present disclosure relates to a sewing machine.

In known art, a sewing machine is known in which, before a start of sewing, an upper thread is guided from a thread spool and is hooked onto a tensioner and a thread take-up lever. In this sewing machine, the upper thread is further guided from the thread take-up lever, and is passed through a needle eye of a sewing needle attached to the lower end of a needle bar, and a state is thus obtained in which sewing is possible.

SUMMARY

In order to apply tension to the upper thread, the tensioner restricts the movement of the upper thread. When a user guides the upper thread as far as the needle eye of the sewing needle via the tensioner, the movement of the upper thread is sometimes restricted by the tensioner. In this case, the user needs to apply force in order to guide the upper thread. As a result, there is an issue that the user cannot easily guide the upper thread as far as the needle eye.

An object of the present disclosure is to provide a sewing machine in which a user can easily guide an upper thread.

Various embodiments herein provide a sewing machine including a thread tension mechanism, a thread feed sensor, a sewing portion, a processor, and a memory. The thread tension mechanism is configured to cause a tension to act on an upper thread. The thread feed sensor is configured to detect a movement of the upper thread. The sewing portion is configured to perform sewing using a sewing needle. The memory is configured to store computer-readable instructions. The instructions, when executed by the processor, perform processes including causing a first tension to act on the upper thread by causing the thread tension mechanism to be in a first state, in a sewing stopped state in which the sewing by the sewing portion is stopped. The instructions also perform processes including causing a second tension to act on the upper thread, by causing the thread tension mechanism to be in a second state, when the movement of the upper thread is detected by the thread feed sensor. The second tension is smaller than the first tension. The instructions also perform processes including causing a third tension to act on the upper thread by causing the thread tension mechanism to be in a third state, in a sewing state in which the sewing by the sewing portion is performed. The third tension is equal to or greater than the second tension.

BRIEF DESCRIPTION OF THE DRAWINGS

Embodiments of the disclosure will be described below in detail with reference to the accompanying drawings in which.

DETAILED DESCRIPTION

Figure 1:
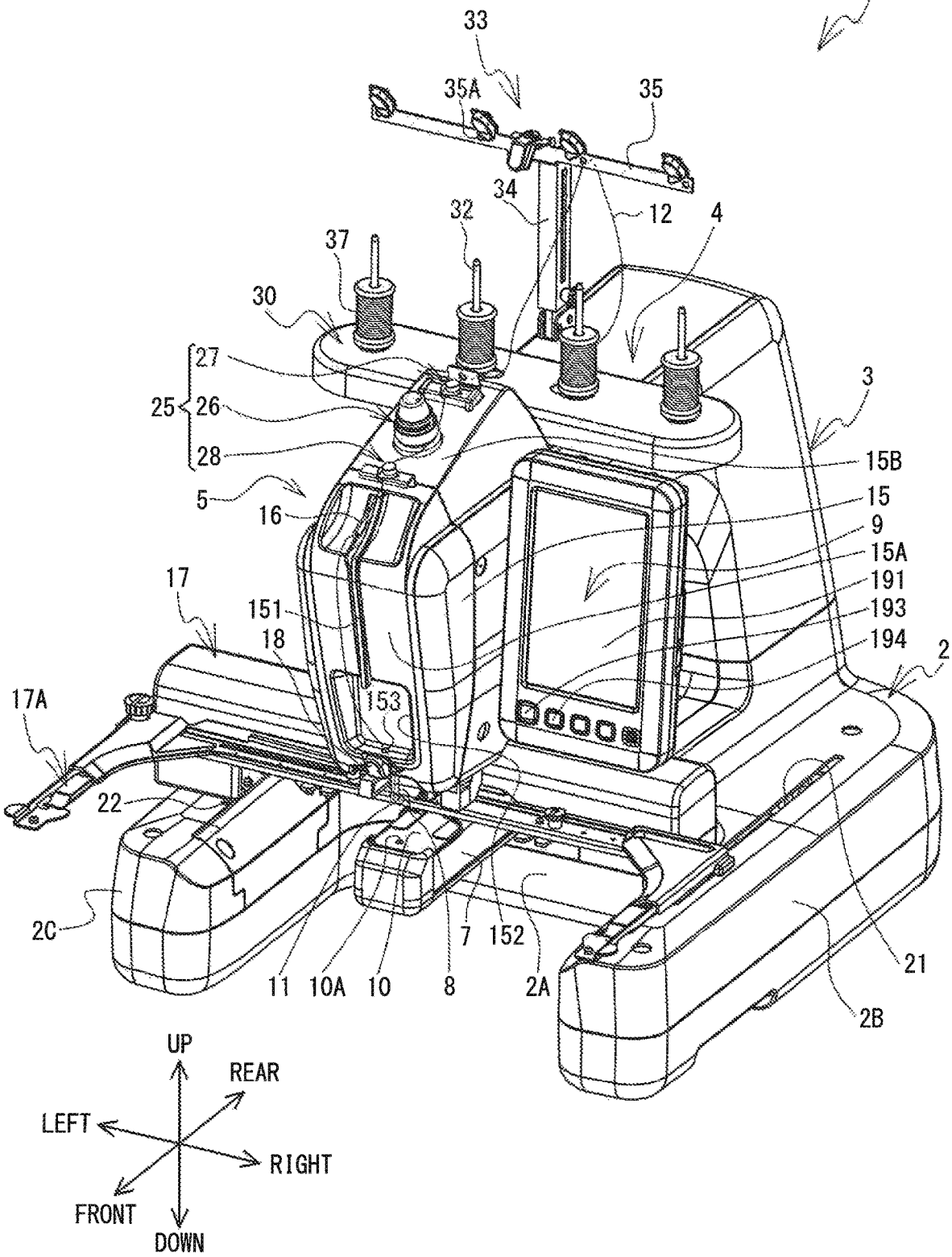
FIG. 1 is a perspective view of a sewing machine 1.

An embodiment of the present disclosure will be explained with reference to the drawings. The upper side, the lower side, the lower left side, the upper right side, the upper left side and the lower right side of FIG. 1 are respectively defined as the upper side, the lower side, the front side, the rear side, the left side and the right side of a sewing machine 1. The left-right direction and the front-rear direction of the sewing machine 1 respectively define an X axis direction and a Y axis direction.

Overall Structure of Sewing Machine 1

The structure of the sewing machine 1 will be explained. As shown in FIG. 1, the sewing machine 1 is provided with a bed portion 2, a pillar 3, an arm portion 4, a head portion 5, an operation panel 9 and the like. The bed portion 2 supports the whole of the sewing machine 1. The bed portion 2 is formed in a substantially U-shape in a plan view, and is provided with a main body portion 2A and a pair of leg portions 2B and 2C. The main body portion 2A is positioned at substantially the center of the bed portion 2 in the left-right direction. The leg portions 2B and 2C are respectively positioned at a left end portion and a right end portion of the main body portion 2A, and extend further to the front than the front surface of the main body portion 2A.

A cylinder bed 7 is provided at substantially the center of the front surface of the main body portion 2A. The cylinder bed 7 extends to the front from the main body portion 2A. A work cloth (not shown in the drawings) is placed on the upper surface of the cylinder bed 7. A shuttle mechanism (not shown in the drawings) is provided inside the cylinder bed 7. The shuttle mechanism rotatably drives a shuttle (not shown in the drawings). The shuttle is provided on the leading end side of the cylinder bed 7, and houses a bobbin (not shown in the drawings) on which a lower thread (not shown in the drawings) is wound. A needle plate 10 is provided on the upper surface of the leading end portion of the cylinder bed 7. A needle hole 10A is provided in the needle plate 10. A sewing needle 8, which will be described later, is inserted through the needle hole 10A in the up-down direction.

The upper surfaces of the leg portions 2B and 2C are respectively provided with guide grooves 21 and 22 that extend in parallel to the Y axis direction. The guide grooves 21 and 22 guide the movement of a carriage 17 in the Y axis direction. The carriage 17 is mounted so as to extend between the leg portions 2B and 2C. A Y axis movement mechanism (not shown in the drawings) is provided in the bed portion 2. The Y axis movement mechanism moves the carriage 17 in the Y axis direction as a result of driving of a Y axis motor 503 (refer to FIG. 9). The front surface of the carriage 17 is provided with a mounting portion 17A such that the mounting portion 17A can move in the X axis direction. An embroidery frame (not shown in the drawings), which holds the work cloth, can be attached to the mounting portion 17A. An X axis movement mechanism (not shown in the drawings) is provided inside the carriage 17. The X axis movement mechanism moves the mounting portion 17A in the X axis direction as the result of driving of an X axis motor 502 (refer to FIG. 9). When the sewing machine 1 performs embroidery sewing, the sewing machine 1 moves the embroidery frame back and forth and left and right, as a result of the movement of the carriage 17 in the front-rear direction by the Y axis movement mechanism and the movement of the mounting portion 17A in the left-right direction by the X axis movement mechanism.

A flat plate-shaped table (not shown in the drawings) can be mounted on the leg portions 2B and 2C. The table is used when sewing is performed in a state in which an operation mode of the sewing machine 1 is set to a free motion mode. The free motion mode will be described later.

The pillar 3 is provided so as to stand on the rear end side of the upper surface of the main body portion 2A. The arm portion 4 extends forward from the upper end portion of the pillar 3 such that the arm portion 4 faces the upper surface of the cylinder bed 7. A thread stand 30 is provided on the upper surface of the arm portion 4. The upper surface of the thread stand 30 is provided with four thread spool pins 32 at equal intervals. Thread spools 37, around which upper threads 12 are wound, are rotatably supported by the thread spool pins 32, respectively. A guide member 33 is provided to the rear of the thread stand 30. The guide member 33 is provided with a columnar support 34 provided so as to stand on the upper surface of the arm portion 4, and a guide bar 35 that extends in the left-right direction from the upper end portion of the columnar support 34. Four holes 35A, through which the upper threads 12 are inserted, are provided in the guide bar 35 at equal intervals.

Figure 2:
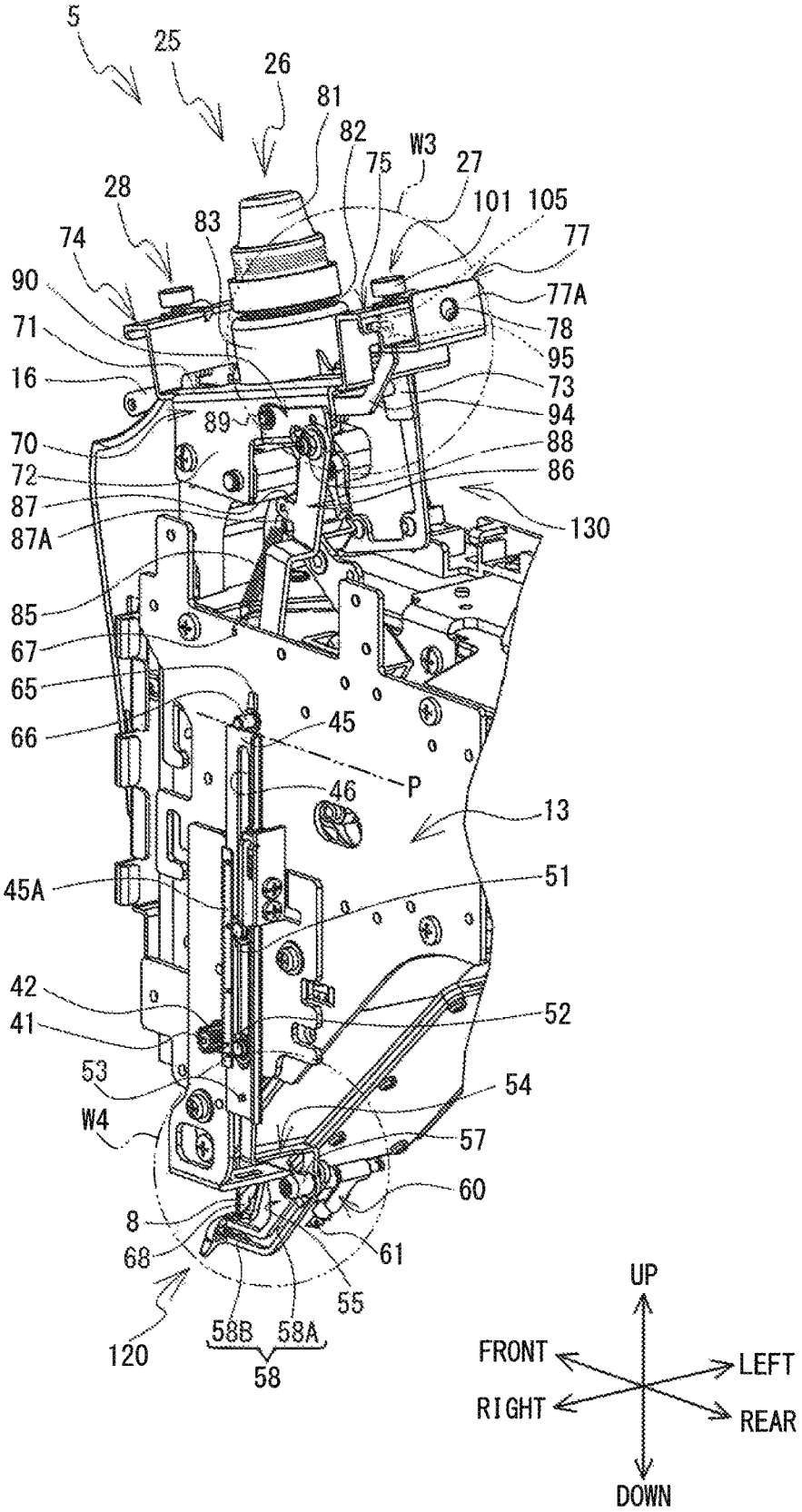
FIG. 2 is a perspective view of a head portion 5 as seen diagonally from the right and the rear.
Figure 4:
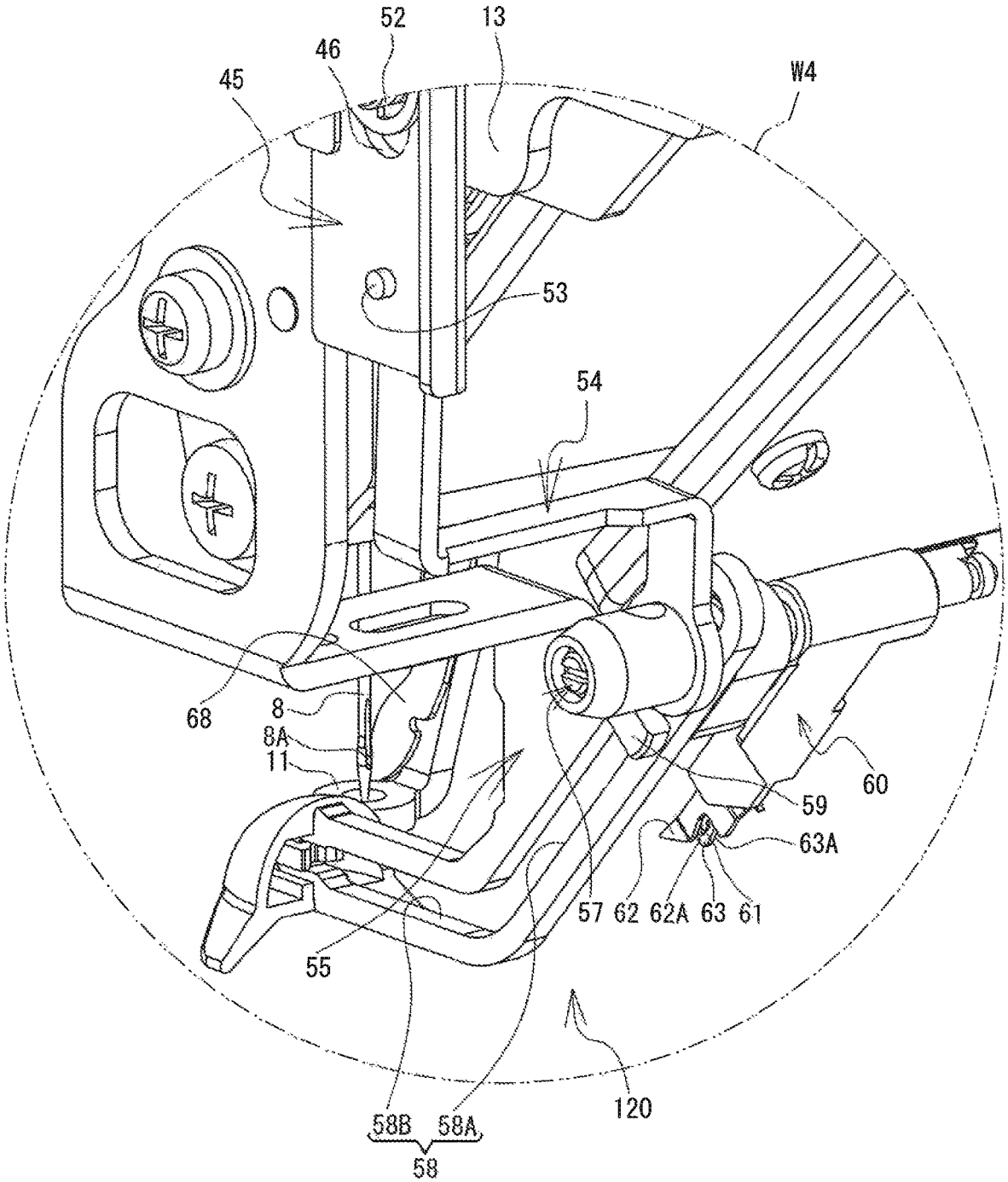
FIG. 4 is a partially enlarged view of an area W4 shown in FIG. 2.

The head portion 5 is provided at the front end portion of the arm portion 4. The head portion 5 is provided with a needle bar case 15. As shown in FIG. 2, a needle bar drive mechanism (not shown in the drawings), a thread take-up mechanism (not shown in the drawings), a threading mechanism 120, an adjustment mechanism 130 and the like are each provided inside the needle bar case 15. The needle bar drive mechanism is provided on the front side of the head portion 5, and supports a needle bar 6 (refer to FIG. 5 and FIG. 7) such that the needle bar 6 can move up and down. The needle bar 6 extends downward from the lower end portion of the head portion 5, and the sewing needle 8 is detachably mounted on the lower end portion of the needle bar 6. A needle eye 8A (refer to FIG. 4), through which the upper thread 12 is passed, is formed in the sewing needle 8. In a state in which the sewing needle 8 is mounted on the needle bar 6, the needle eye 8A is directed in the front-rear direction. A presser member 11 (refer to FIG. 1) that has an L shape in a front view is provided to the left of the sewing needle 8. The lower end portion of the presser member 11 is positioned below the lower end (the leading end) of the sewing needle 8, and a hole (not shown in the drawings), through which the sewing needle 8 is inserted, is formed therein. A thread holding plate 68 made of a thin flat plate is fixed to the right side surface of the presser member 11. As shown in FIG. 4, the lower end portion of the thread holding plate 68 is formed in a substantially V shape, and protrudes further to the front than the presser member 11.

As shown in FIG. 1, the thread take-up mechanism causes a thread take-up lever 16 to move up and down in accordance with the up and down movement of the needle bar 6. The thread take-up lever 16 moves up and down along a slit 151 provided in a front surface 15A of the needle bar case 15. When a sewing operation of the sewing machine 1 is performed, the needle bar 6 and the sewing needle 8 operate in cooperation with the shuttle, and cause the upper thread 12 to be entwined with the lower thread pulled out from the bobbin housed in the shuttle. The thread take-up lever 16 pulls the upper thread 12 entwined with the lower thread up onto the needle plate 10. By the above-described processing, a stitch is formed on the work cloth.

An inclined surface 15B is provided on the upper surface of the needle bar case 15. The inclined surface 15B is provided with a thread tension mechanism 25 for applying a tension to the upper thread 12. The thread tension mechanism 25 is provided with a sub-tensioner 27, a main tensioner 26 and a sub-tensioner 28 in that order from an upstream side to a downstream side in a direction (hereinafter referred to as a "supply direction") in which the upper thread 12 is pulled out from the thread spool 37. The main tensioner 26 is provided with a rotating disk 82 (refer to FIG. 2) to be described later, and the rotating disk 82 rotates in conjunction with a movement amount of the upper thread 12, thus applying the tension to the upper thread 12. Each of the sub-tensioners 27 and 28 clamps the upper thread 12 using a clamping portion 103 (refer to FIG. 3) to be described later, and thus applies the tension to the upper thread 12. Specific structures and mechanisms for applying the tension of the main tensioner 26 and each of the sub-tensioners 27 and 28 will be described later.

A thread holding member 18 is supported on the front of the lower end portion of the front surface 15A of the needle bar case 15 such that the thread holding member 18 can swing in the front-rear direction. The thread holding member 18 provisionally holds the end portion of the upper thread 12 that is hooked onto a threading hook 61 (refer to FIG. 4) to be described later, before the upper thread 12 is pulled to the front of the front surface 15A and is passed through the needle eye 8A of the sewing needle 8 (hereinafter referred to as "threading"). A blade portion (not shown in the drawings) that cuts the upper thread 12, and a clamping portion (not shown in the drawings) that clamps and holds the end portion of the upper thread 12 cut by the blade portion are provided inside the thread holding member 18. After passing the upper thread 12 from the left to the right in the thread holding member 18 and causing the upper thread 12 to be held by the clamping portion, a user pulls the upper thread 12 downward. By the above-described processing, the upper thread 12 is cut by the blade portion and the end portion of the upper thread 12 is clamped by the clamping portion.

A recessed portion 152 that is recessed to the rear is provided in the lower side of the front surface 15A of the needle bar case 15. A guide hole 153 is provided in a substantially central portion of the lower surface on the inside of the recessed portion 152. The upper thread 12 is caused to pass through the guide hole 153, via the thread take-up lever 16, and the guide hole 153 guides the upper thread 12 to the sewing needle 8 side.

The operation panel 9 is provided adjacent to the right side of the head portion 5, and is provided with a liquid crystal display 191 (hereinafter referred to as the "LCD 191"), a touch panel 192 (refer to FIG. 9), a start/stop key 193 (hereinafter referred to as the "S/S key 193"), a threading key 194, and the like. Various types of information, such as, for example, an operation screen for the user to input a command and a selection screen to select various operation modes of the sewing machine 1 to be described later, are displayed on the LCD 191. The touch panel 192 receives a command from the user, by detecting a position touched by a finger on the LCD 191. The S/S key 193 is a key to issue a command to start or stop the sewing. The threading key 194 is a key to receive a drive command of the threading mechanism 120.

Thread Tension Mechanism 25

The support structure of the thread tension mechanism 25 will be explained. As shown in FIG. 2, a tensioner base 70 is provided on the upper portion of the head portion 5 from which the needle bar ease 15 has been removed. The tensioner base 70 is formed in a substantially reverse U shape in cross section. The tensioner base 70 is provided with an upper wall 71, a right side wall 72, a left side wall 73, a front side support portion 74, a rear side support portion 75, a thread guide portion 77 and the like. The upper wall 71 is disposed on the upper portion of the head portion 5 and is inclined downward from the rear toward the front. The main tensioner 26 is fixed onto the upper surface of the upper wall 71. The right side wall 72 extends downward from the right end portion of the upper wall 71, and is fixed to the right side surface of the head portion 5, The left side wall 73 extends downward from the left end portion of the upper wall 71 and is fixed to the left side surface of the head portion 5.

The front side support portion 74 is provided on the front end portion of the upper wall 71. The front side support portion 74 is formed in a substantially reverse L shape in a side view, extends vertically upward from the front end portion of the upper wall 71, and further extends while bending at a substantial right angle toward the front from the upper end thereof. The sub-tensioner 28 is provided on the upper surface of the section of the front side support portion 74 that extends toward the front. The rear side support portion 75 is provided on the rear end portion of the upper wall 71. The rear side support portion 75 is symmetrical with the front side support portion 74. The rear side support portion 75 extends vertically upward from the rear end portion of the upper wall 71, and further extends while bending at a substantial right angle toward the rear from the upper end thereof. The sub-tensioner 27 is provided on the upper surface of the section of the rear side support portion 75 that extends toward the rear. A screw hole 75A and a through hole 75B (refer to FIG. 3) are respectively provided in the section on which the sub-tensioner 27 is provided. A shaft portion 102 (to be described later) of the sub-tensioner 27 is fastened into the screw hole 75A. A pin 105 provided on the clamping portion 103 (to be described later) of the sub-tensioner 27 is inserted through the though hole 75B.

Figure 3:
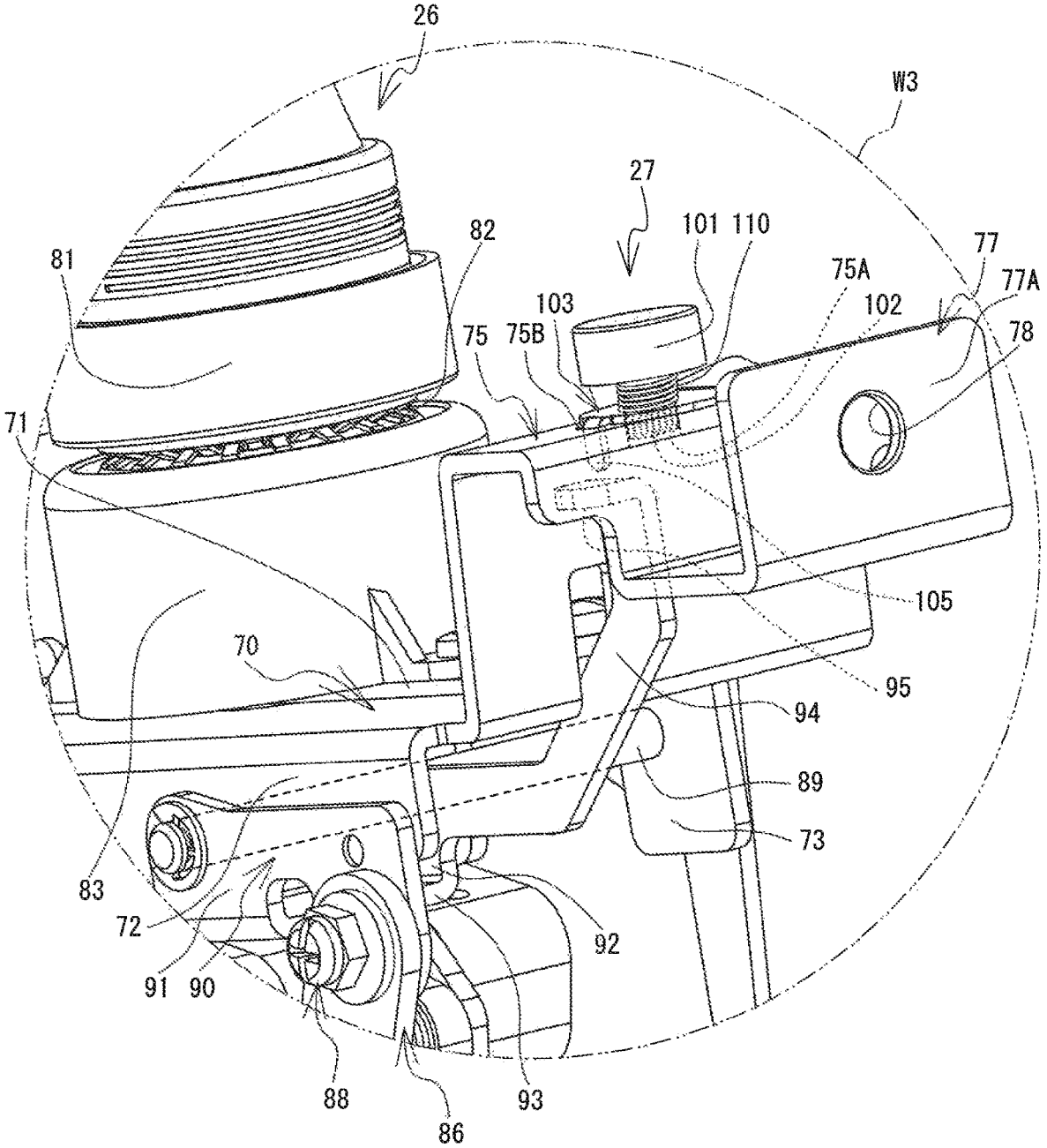
FIG. 3 is a partially enlarged view of an area W3 shown in FIG. 2.

As shown in FIG. 3, the thread guide portion 77 is provided on the rear end portion of the section of the rear side support portion 75 that extends while bending to the rear, and is formed in a substantially U shape in cross-section. A circular guide hole 78 is provided in substantially the center of a wall portion 77A on the rear end side of the thread guide portion 77. The upper thread 12 that is conveyed from the guide member 33 (refer to FIG. 1) is caused to pass through the guide hole 78, and the guide hole 78 guides the upper thread 12 toward the sub-tensioner 27.

The structure of the main tensioner 26 will be explained with reference to FIG. 3. The main tensioner 26 is provided with a main body member 83, the rotating disk 82, an adjustment dial 81 and the like, in that order from below. The main body member 83 is formed in a substantially cylindrical shape, and is fixed by a screw to the upper surface of the upper wall 71 of the tensioner base 70. The rotating disk 82 is axially supported so as to be rotatable, and is exposed to the outside at the upper portion of the main body member 83. The upper thread 12 is wound once around the rotating disk 82. The adjustment dial 81 urges the rotating disk 82 from above, and adjusts an urging force by which the rotating disk 82 is urged, thus adjusting a rotational resistance of the rotating disk 82. More specifically, the adjustment dial 81 is internally provided with a thread tension disc (not shown in the drawings), and a coil spring (not shown in the drawings) that urges the thread tension disc from above. As a result of this, the rotating disk 82 is urged, from above, by the coil spring, via the thread tension disc. Thus, the main tensioner 26 can cause the rotational resistance force by the urging of the rotating disk 82 to act on the upper thread 12 wound around the rotating disk 82. The tension applied to the upper thread 12 by the rotating disk 82 of the main tensioner 26 is significantly weaker than a tension applied to the upper thread 12 by the sub-tensioner 27 to be described later. More specifically, the main tensioner 26 applies an extremely weak tension to the upper thread 12 to a degree that the upper thread 12 does not become removed from the rotating disk 82. A thread feed sensor 19 (refer to FIG. 9) is incorporated into the main body member 83. The thread feed sensor 19 can detect a rotation amount of the rotating disk 82.

The structure of the sub-tensioners 27 and 28 will be explained with reference to FIG. 3. Note that since the same structure is common to both the sub-tensioners 27 and 28, only the sub-tensioner 27 will be explained, and an explanation of the structure of the sub-tensioner 28 will be omitted. The sub-tensioner 27 is provided with a cap 101, the shaft portion 102, the clamping portion 103, a coil spring 110 and the like. The shaft portion 102 is, for example, a bolt in which a screw thread is formed in an outer peripheral surface thereof, and is screwed into the screw hole 75A provided in the rear side support portion 75 of the tensioner base 70. By adjusting an amount by which the shaft portion 102 is screwed into the screw hole 75A, the height of the shaft portion 102 can be adjusted. The cap 101 is a substantially circular columnar shape, and can be removably attached to a head portion (not shown in the drawings) of the shaft portion 102.

The clamping portion 103 is a metal plate member that is substantially rectangular in a plan view and that is disposed on the upper surface of the rear side support portion 75. A circular hole portion 103A (refer to FIG. 8) is provided in substantially the center of the clamping portion 103. The shaft portion 102 is inserted through the hole portion 103A. One end portion of the clamping portion 103 is formed in a substantially semicircular arc shape in a plan view, and the pin 105, which bends and protrudes downward, is provided in substantially the center portion of the clamping portion 103 in the longitudinal direction. The pin 105 is inserted through the through hole 75B provided in the rear side support portion 75 of the tensioner base 70, and protrudes downward from the back surface of the rear side support portion 75.

The coil spring 110 is provided around the shaft portion 102. One end side, in the axial direction, of the coil spring 110 is in contact with the bottom surface of the cap 101, and the other end portion is in contact with the upper surface of the clamping portion 103. Thus, the coil spring 110 is compressed between the cap 101 and the clamping portion 103, and constantly urges the clamping portion 103 against the upper surface of the rear side support portion 75. The tension is applied to the upper thread 12 by clamping the upper thread 12 between the clamping portion 103 and the upper surface of the rear side support portion 75 in this state. When the amount by which the shaft portion 102 is screwed into the screw hole 75A is adjusted, a compression amount of the coil spring 110 changes, and thus the urging force against the clamping portion 103 can be changed. The sub-tensioner 28 applies more tension to the upper thread 12 that is conveyed from the main tensioner 26, but the tension that is applied to the upper thread 12 by the sub-tensioner 28 is significantly weaker than the tension applied to the upper thread 12 by the sub-tensioner 27. More specifically, the sub-tensioner 28 applies an extremely weak tension to the upper thread 12 such that the upper thread 12 does not become removed from the sub-tensioner 28.

Threading Mechanism 120

The structure of the threading mechanism 120 will be explained. As shown in FIG. 2, the threading mechanism 120 is provided with a threading motor 504 (refer to FIG. 9), a rack member 45, a crank plate 54, a guide frame 55 and a link block 60. An output shaft 41 of the threading motor 504 protrudes to the right via a hole (not shown in the drawings) provided in a sewing machine frame 13. A pinion gear 42 is fixed to the leading end portion of the output shaft 41.

The rack member 45 is formed in a substantially rectangular plate shape that extends in the up-down direction, and is provided adjacent to the rear side of the pinion gear 42. A gear portion 45A provided at the front end portion of the rack member 45 meshes with the pinion gear 42. The rack member 45 is provided with a guide groove 46 that is parallel to its longitudinal direction. The guide groove 46 is engaged with guide pins 51 and 52 fixed to the sewing machine frame 13. The guide pins 51 and 52 are disposed so as to he separated from each other in the up-down direction. Thus, the rack member 45 is guided in the up-down direction by the guide groove 46 moving in the up-down direction in a state in which the guide groove 46 is engaged with the guide pins 51 and 52. When the head portion 5 is viewed from the right side, when the output shaft 41 and the pinion gear 42 of the threading motor 504 rotate clockwise, the rack member 45 moves downward. When the output shaft 41 and the pinion gear 42 rotate counterclockwise, the rack member 45 moves upward.

As shown in FIG. 4, the guide frame 55 is fixed to the lower portion of the sewing machine frame 13. The guide frame 55 is inclined downward and forward from the lower portion of the sewing machine frame 13, and further, the front end side of the guide frame 55 bends forward and extends substantially horizontally. The front end portion of the guide frame 55 that extends substantially horizontally is positioned to the right of the sewing needle 8 and at substantially the same height as the lower end portion of the sewing needle 8. A guide groove 58 is formed in the guide frame 55. The guide groove 58 has an inclined portion 58A and a horizontal portion 58B that accord with the shape of the guide frame 55. A rod-shaped engagement pin 57 is slidably engaged with the guide groove 58. The engagement pin 57 extends in the left-right direction via the guide groove 58, and is coupled to the rear end portion of the link block 60, which will be described later, on the left side of the guide frame 55. Further, on the right side of the guide frame 55, the engagement pin 57 is rotatably coupled to the lower end portion of the crank plate 54, which will be described later. Further, a contact portion 59 is fixed to the front side of the engagement pin 57. The contact portion 59 slides along the guide groove 58 together with the engagement pin 57, and the movement of the engagement pin 57 is stopped by the contact portion 59 coming into contact with the front end portion of the horizontal portion 58B when the horizontal portion 58B is moved forward.

The crank plate 54 is disposed between the lower end portion of the rack member 45 and the guide frame 55. When the head portion 5 is viewed from the front, the crank plate 54 is formed such that a section between one end portion and the other end portion in the longitudinal direction of the crank plate 54 is bent in a substantially Z shape. The one end portion of the crank plate 54 is rotatably coupled to the inner surface of the lower end portion of the rack member 45 via a shaft support portion 53, and the other end portion is rotatably coupled to the engagement pin 57 on the right side of the guide frame 55.

The rear end portion of the link block 60 is coupled to the engagement pin 57 on the left side of the guide frame 55. The link block 60 is formed in a substantially cuboid shape, and extends in a direction orthogonal to the axial direction of the engagement pin 57, along the shape of the guide frame 55. A pair of left and right thread hook members 62 and 63 are provided at the leading end portion of the link block 60. The threading hook 61 is provided between the thread hook members 62 and 63. The lower end portions of the thread hook members 62 and 63 are respectively provided with inclined portions 62A and 63A that are inclined diagonally upward toward the rear of the link block 60. By the engagement pin 57 sliding from a deepest portion, to the rear, of the guide groove 58 along the inclined portion 58A and along the horizontal portion 58B in that order, the link block 60 is first guided obliquely downward and forward, and then guided forward in the horizontal direction. At this time, the leading end portion of the link block 60 moves toward the needle eye 8A of the sewing needle 8, and the threading hook 61 is inserted through the needle eye 8A of the sewing needle 8. When the contact portion 59 comes into contact with the front end portion of the guide groove 58, the link block 60 stops, together with the engagement pin 57.

Adjustment Mechanism 130

The structure of the adjustment mechanism 130 will be explained. As shown in FIG. 2, the adjustment mechanism 130 is provided on the upper portion on the rear surface side of the head portion 5, and adjusts the tension applied to the upper thread 12 by the sub-tensioner 27. The adjustment mechanism 130 is provided with an engagement pin 66, a link member 86, a coil spring 85, a support shaft 89, and an adjustment member 90. The adjustment mechanism 130 uses the threading motor 504 (refer to FIG. 9) of the threading mechanism 120, as a common drive source.

The engagement pin 66 engages with a long hole 65 provided in the upper side of the sewing machine frame 13, such that the engagement pin 66 can slide along the long hole 65. The long hole 65 is provided in the sewing machine frame 13 in a position corresponding to the upper end of a range over which the rack member 45 moves in the up-down direction, and is formed in a rectangular shape that is long in the up-down direction. The rack member 45 that moves up and down comes into contact with and separates from the engagement pin 66 from below. The link member 86 is disposed between the tensioner base 70 and the sewing machine frame 13, and is a plate member shaped as a long thin rectangle extending in the up-down direction. The substantially center portion of the link member 86 between the upper end portion and the lower end portion of the link member 86 is bent in a crank shape. The lower end portion of the link member 86 is coupled to the engagement pin 66, and the upper end portion of the link member 86 is rotatably coupled, via a shaft support portion 88, to the right side wall 91 (refer to FIG. 3) of the adjustment member 90 to be described later.

A protruding piece 87, which protrudes to the front in a semicircular arc shape, is provided on the front side of the link member 86, slightly above the section. that is bent into the crank shape. A circular spring locking hole 87A is provided in substantially the center of the protruding piece 87. One end of the coil spring 85 is locked into the spring locking hole 87A, The other end of the coil spring 85 is locked into a locking hole 67 that is provided in the upper end portion of the sewing machine frame 13, further to the front than the link member 86. The coil spring 85 constantly urges the link member 86 downward. When the rack member 45 is positioned lower than a reference position P to be described later, as a result of the link member 86 being urged downward by the coil spring 85, the engagement pin 66 is pressed further downward than the upper end portion of the long hole 65.

As shown in FIG. 3, the adjustment member 90 is formed in a substantially U shape in a front view, and is provided so as to be able to swing around the support shaft 89 provided inside the tensioner base 70. The support shaft 89 extends in the left-right direction and is provided so as to bridge between the right side wall 72 and the left side wall 73 of the tensioner base 70. The adjustment member 90 is provided with a right side wall 91, a left side wall 92, a bottom wall 93, and an arm portion 94. The right side wall 91 and the left side wall 92 respectively extend in a standing manner from both end portions, on the left and the right, of the bottom wall 93 that is a substantially rectangular shape in a plan view. The right side wall 91 is disposed to the right of the right side wall 72 of the tensioner base 70, the left side wall 92 is disposed to the left of the right side wall 72, and the bottom wall 93 is disposed below the right side wall 72. The support shaft 89 is inserted through the front end sides of each of the right side wall 91 and the left side wall 92. Due to the above-described structure, the adjustment member 90 is supported such that the rear end side thereof is able to swing up and down around the support shaft 89.

The arm portion 94 extends substantially horizontally to the rear from the upper portion of the rear end portion of the left side wall 92, and further, is inclined diagonally upward such that the leading end side of the arm portion 94 extends upward. A pressing-up portion 95, which bends to the right at a substantial right angle, is provided on the leading end portion of the arm portion 94, The pressing-up portion 95 is disposed below the through hole 75B provided in the rear side support portion 75 of the tensioner base 70. The upper end portion of the link member 86 is rotatably coupled, via the shaft support portion 88, to a lower side corner portion on the rear end side of the right side wall 91 of the adjustment member 90.

As described above, in the adjustment mechanism 130, the link member 86 is constantly urged downward by the coil spring 85. As a result, in a state in which the engagement pin 66 is not being pushed up by the rack member 45, the link member 86 pulls down the right side wall 91 of the adjustment member 90, via the shaft support portion 88. Thus, the adjustment member 90 swings in the clockwise direction in a right side view around the support shaft 89. The arm portion 94 swings downward around the support shaft 89, and thus, the pressing-up portion 95 is positioned lower than the leading end portion of the pin 105 protruding downward from the through hole 75B. In this state, the clamping portion 103 of the sub-tensioner 27 is not pressed up by the pin 105.

The movement range of the rack member 45 and the reference position P will be explained with reference to FIG. 2. As described above, the rack member 45 is guided in the up-down direction by the guide pins 51 and 52. The movement range of the rack member 45 in the up-down direction is adjusted by the respective positions of the guide pins 51 and 52, and by the length of the guide groove 46. In the sewing machine 1, when neither the threading mechanism 120 nor the adjustment mechanism 130 is being driven, the rack member 45 is disposed in the reference position P. The reference position P is, for example, a position at which the upper end portion of the rack member 45 is at the same height as a lowermost point of the engagement pin 66 engaged in the long hole 65. When the rack member 45 is disposed in the reference position P, the engagement pin 66 is positioned at a lowermost end of its movement range in the long hole 65, and is in a state of not being urged upward by the rack member 45, The sewing machine 1 moves the rack member 45 by driving the threading motor 504 in the forward and reverse directions. When the rack member 45 has moved below the reference position P, the threading mechanism 120 operates, and when the rack member 45 has moved above the reference position P, the adjustment mechanism 130 operates. Due to the above-described structure, the sewing machine 1 selectively uses the threading mechanism 120 and the adjustment mechanism 130, in accordance with the movement range of the rack member 45.

Threading Operation by Threading Mechanism 120

A threading operation by the threading mechanism 120 will be explained. As shown in FIG. 4, at a preparatory stage before the start of a sewing operation of the sewing machine 1, the engagement pin 57 is positioned at the deepest portion, to the rear, of the guide groove 58. As a result, the link block 60 is positioned to the rear of the lower portion of the head portion 5. At this time, the threading hook 61 is in a stand-by position. The rack member 45 is disposed in the reference position P.

Figure 5:
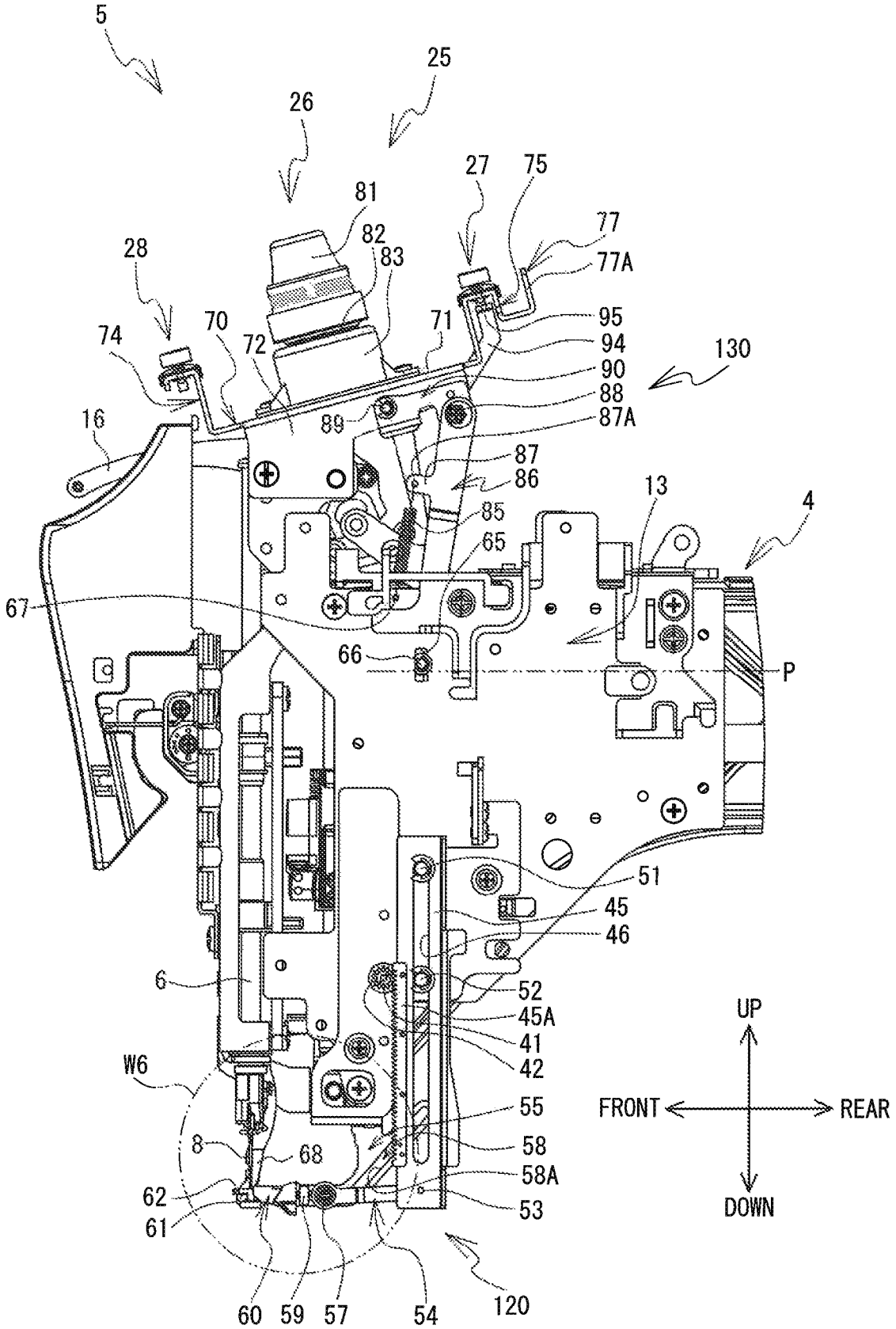
FIG. 5 is a right side view of the head portion 5 (when a rack member 45 is in a lower position)
Figure 6:
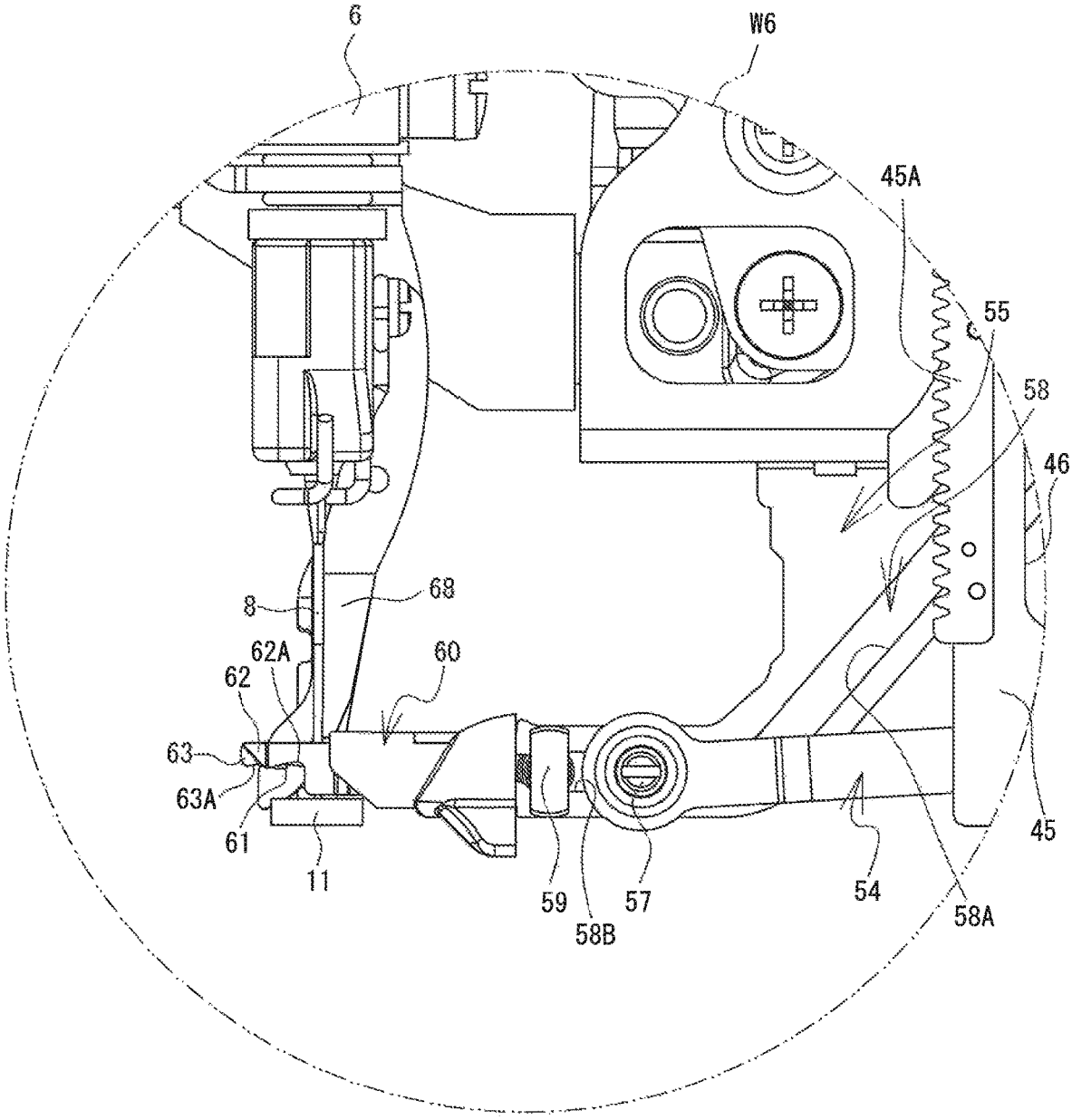
FIG. 6 is a partially enlarged view of an area W6 shown in FIG. 5.

When the user depresses the threading key 194, the threading motor 504 (refer to FIG. 9) rotates in the forward direction and the pinion gear 42 rotates clockwise in a right side view together with the output shaft 41. In response to this, the rack member 45 moves downward from the reference position P while being guided downward by the guide pins 51 and 52, as shown in FIG. 5. The other end portion of the crank plate 54, whose one end portion is coupled to the lower end portion of the rack member 45 via the shaft support portion 53, pushes down the engagement pin 57. As a result, the engagement pin 57 slides over the inclined portion 58A and the horizontal portion 58B, in that order, along the guide groove 58. In accordance with the sliding of the engagement pin 57, the link block 60 moves diagonally downward and forward along the inclined portion 58A, and then moves forward in the horizontal direction along the horizontal portion 58B. Then, when the contact portion 59 comes into contact with the front end portion of the horizontal portion 58B, the link block 60 stops. The position of the rack member 45 when the contact portion 59 is in contact with the front end portion of the horizontal portion 58B is referred to as a "lower position." At this time, as shown in FIG. 6, the threading hook 61 is inserted through the needle eye SA (refer to FIG. 4) of the sewing needle 8. The forward driving of the threading motor 504 is stopped.

The user hooks the upper thread 12 inserted into the guide hole 153 (refer to FIG. 1) inside the recessed portion 152 onto the thread hook member 62, the threading hook 61, the thread hook member 63 and the lower end portion of the thread holding plate 68 in that order from the right to the left. After that, after the upper thread 12 is caused to be held by the clamping portion of the thread holding member 18 (refer to FIG. 1), the upper thread 12 is cut by the blade portion (not shown in the drawings). The end portion of the cut upper thread 12 is held by the clamping portion. Next, when the user depresses the threading key 194 displayed on the operation panel 9 once again, the threading motor 504 is driven in the reverse direction and the threading hook 61 moves to the rear. The threading motor 504 stops at a point in time at which the threading hook 61 has moved to a predetermined position where the threading hook 61 slips out of the needle eye 8A and moves rearward away from the needle eye 8A. At this time, a thread loop having a loop shape is formed between the needle eye 8A and the threading hook 61.

Next, in order to remove the thread loop, another drive motor (not shown in the drawings) for driving a thread pulling member (not shown in the drawings) is driven. The thread pulling member is driven and moved diagonally downward and forward, and the leading end portion of the thread pulling member hooks the thread loop. After that, when the thread pulling member is moved upward to an original rear position by the drive motor, the free end side of the thread loop held between the threading hook 61 and the needle eye 8A is pulled and disengaged from the threading hook 61. In this manner, a state is achieved in which the upper thread 12 has completely passed through the needle eye 8A. After that, the threading motor 504 is driven in the reverse direction, the threading hook 61 is returned to the stand-by position, and the threading is complete. After the rack member 45 has moved upward as far as the reference position P, the rack member 45 stops.

Adjustment Operation of Tension by Adjustment Mechanism 130

Figure 7:
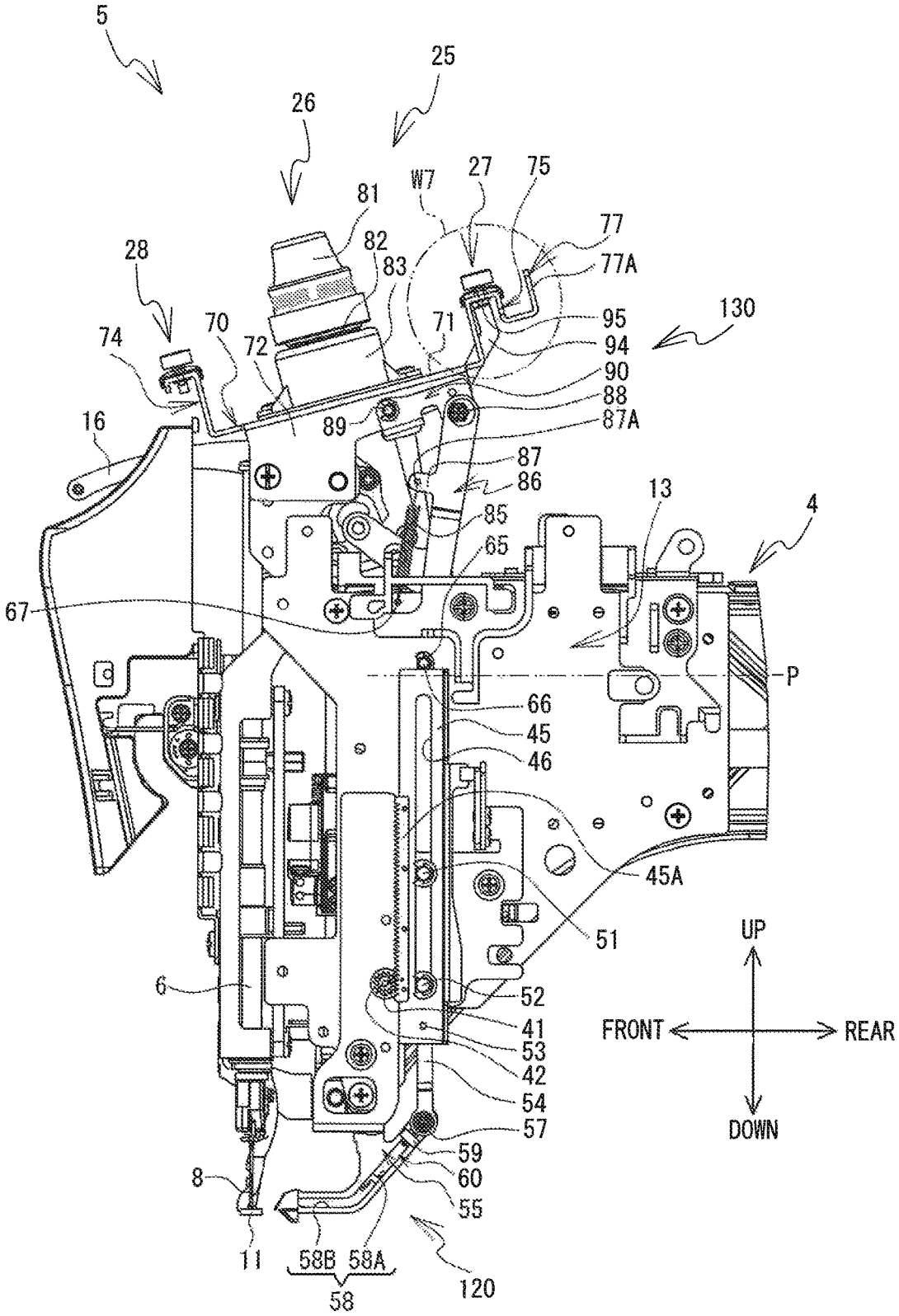
FIG. 7 is a right side view of the head portion 5 (when the rack member 45 is in an upper position)

An adjustment operation of the tension of the upper thread 12 by the adjustment mechanism 130 will be explained. When the threading motor 504 (refer to FIG. 9) is driven in the reverse direction, the pinion gear 42 rotates counterclockwise in a right side view, together with the output shaft 41. As shown in FIG. 7, the rack member 45 moves upward while being guided by the guide pins 51 and 52, thus moving above the reference position P. The upper end portion of the rack member 45 comes into contact, from below, with the engagement pin 66 engaged in the long hole 65, and presses the engagement pin 66 upward. In this way, the link member 86 resists the urging force of the coil spring 85, and is pushed upward. Further, the upper end portion of the link member 86 pushes the rear end side of the right side wall 91 of the adjustment member 90 upward, via the shaft support portion 88, and thus, the adjustment member 90 swings counterclockwise in a right side view around the support shaft 89. The engagement pin 66 moves upward until it touches the upper end portion of the long hole 65. The upward movement of the rack member 45 is stopped by the contact of the engagement pin 66 with the upper end portion of the long hole 65. The reverse driving of the threading motor 504 is stopped. The position of the rack member 45 when the engagement pin 66 is in contact with the upper end portion of the long hole 65 is referred to as an "upper position."

Figure 8:
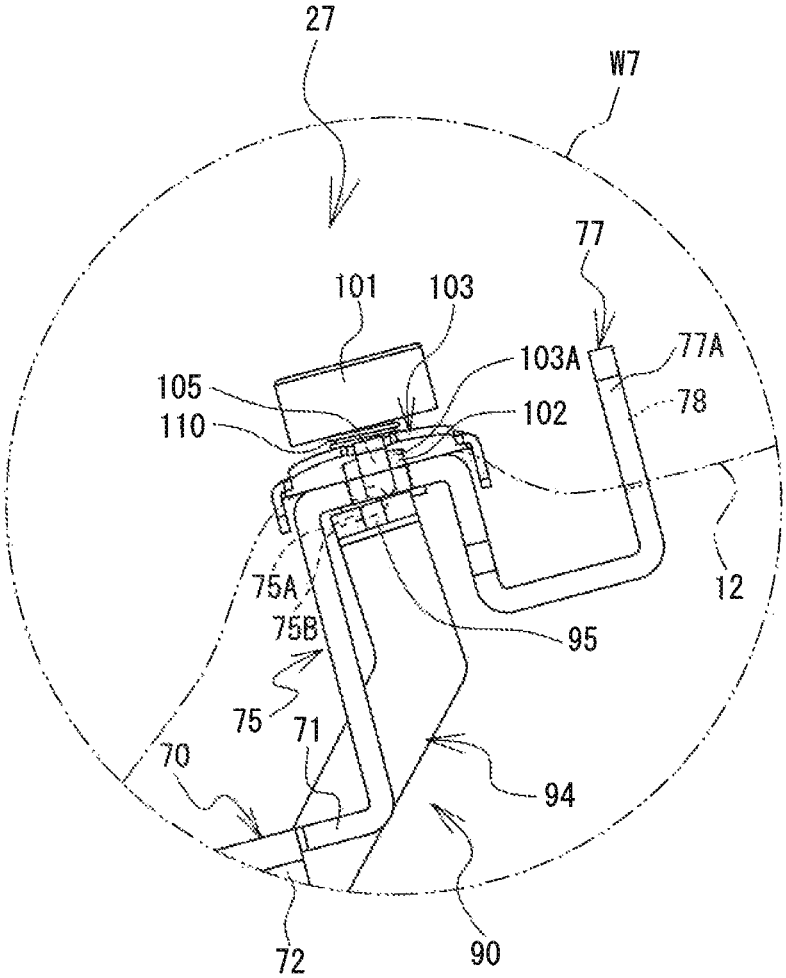
FIG. 8 is a partially enlarge view of an area W7 shown in FIG. 7.

As shown in FIG. 8, the arm portion 94 swings upward, and the pressing-up portion 95 provided on the leading end portion of the arm portion 94 comes into contact with the pin 105 protruding downward from the through hole 75B, and pushes the pin 105 upward. The clamping portion 103 of the sub-tensioner 27 is pushed up and a gap occurs between the clamping portion 103 and the upper surface of the rear side support portion 75. The clamping portion 103 and the rear side support portion 75 separate from each other. In this case, the tension acting on the upper thread 12 by the sub-tensioner 27 when the upper thread 12 has moved in the supply direction is at its smallest, and is substantially zero. Thus, the upper thread 12 can move freely in the supply direction. Hereinafter, a state of the sub-tensioner 27 when the rack member 45 is disposed in the upper position is referred to as a "second state." When the sub-tensioner 27 is in the second state, the tension acting on the upper thread 12 is referred to as a "second tension."

A clamping force of the upper thread 12 between the rear side support portion 75 and the damping portion 103 of the sub-tensioner 27 changes in accordance with a degree to which the pressing-up portion 95 of the arm portion 94 pushes up the clamping portion 103. When the rack member 45 is disposed in a position (hereinafter referred to as a "first intermediate position") slightly below the upper position, in comparison to when the rack member 45 is disposed in the upper position, the gap between the damping portion 103 of the sub-tensioner 27 and the rear side support portion 75 is smaller. In this case, the tension acting on the upper thread 12 that has moved in the supply direction is larger than the second tension. Hereinafter, the state of the sub-tensioner 27 when the rack member 45 is disposed in the first intermediate position is referred to as a "fourth state." The tension acting on the upper thread 12 when the sub-tensioner 27 is in the fourth state is referred to as a "fourth tension."

When the rack member 45 is disposed in the reference position P, or when the rack member 45 is disposed in the lower position that is below the reference position P in order to perform the threading operation, the clamping portion 103 of the sub-tensioner 27 and the rear side support portion 75 are in mutual contact when the upper thread 12 is riot interposed therebetween, and the gap does not occur between the clamping portion 103 and the rear side support portion 75. In this case, when the upper thread 12 has moved in the supply direction in the state in which the upper thread 12 is interposed between the clamping portion 103 and the rear side support portion 75, the tension acting on the upper thread 12 is at its largest. Hereinafter, the state of the sub-tensioner 27 when the rack member 45 is disposed in the reference position P or below the reference position P (including the lower position) is referred to as a "first state," or a "third state." In the present embodiment, the first state and the third state arc the same state, and in both cases, are a state in which the clamping portion 103 of the sub-tensioner 27 and the rear side support portion 75 are in mutual contact with the upper thread 12 not interposed between the clamping portion 103 and the rear side support portion 75. As will be described in more detail later, below, the first state and the third state are selectively used in accordance with a state of the sewing machine 1. In the present embodiment, the first state is a state of the sub-tensioner 27 when the sewing by the sewing machine 1 has been stopped, and the third state is a state of the sub-tensioner 27 when, as will be described later, the threading key 194 has been depressed and the sewing is performed by the sewing machine 1. When the sub-tensioner 27 is in the first state, the tension acting on the upper thread 12 is referred to as a "first tension." When the sub-tensioner 27 is in the third state, the tension acting on the upper thread 12 is referred to as a "third tension." In the present embodiment, the first tension and the third tension are the same. The first tension and the third tension are both larger than the second tension and the fourth tension.

Operation Modes

Operation modes of the sewing machine 1, which can be selected using the operation panel 9, will be explained. The user can select the operation mode of the sewing machine 1 using a selection screen displayed on the operation panel 9. The operation modes include, for example, an embroidery sewing mode and a free motion mode. The embroidery sewing mode is a mode in which embroidery sewing is performed while automatically moving the embroidery frame, which holds the work cloth, in the X axis direction and the Y axis direction with respect to the sewing needle 8 that moves up and down. The embroidery frame is mounted on the mounting portion 17A of the carriage 17. The free motion mode is a mode in which the sewing is performed while the user moves the work cloth manually without using the embroidery frame. For example, when quilting sewing is performed, the user selects the free motion mode on the operation panel 9. When the free motion mode is selected on the operation panel 9, the carriage 17 moves to the rear. In this state, the user mounts the table on the leg portions 2B and 2C, and places the work cloth on the table. The user can perform the quilting sewing by manually moving the work cloth on the table with respect to the sewing needle 8 that moves up and down.

Electrical Configuration

Figure 9:
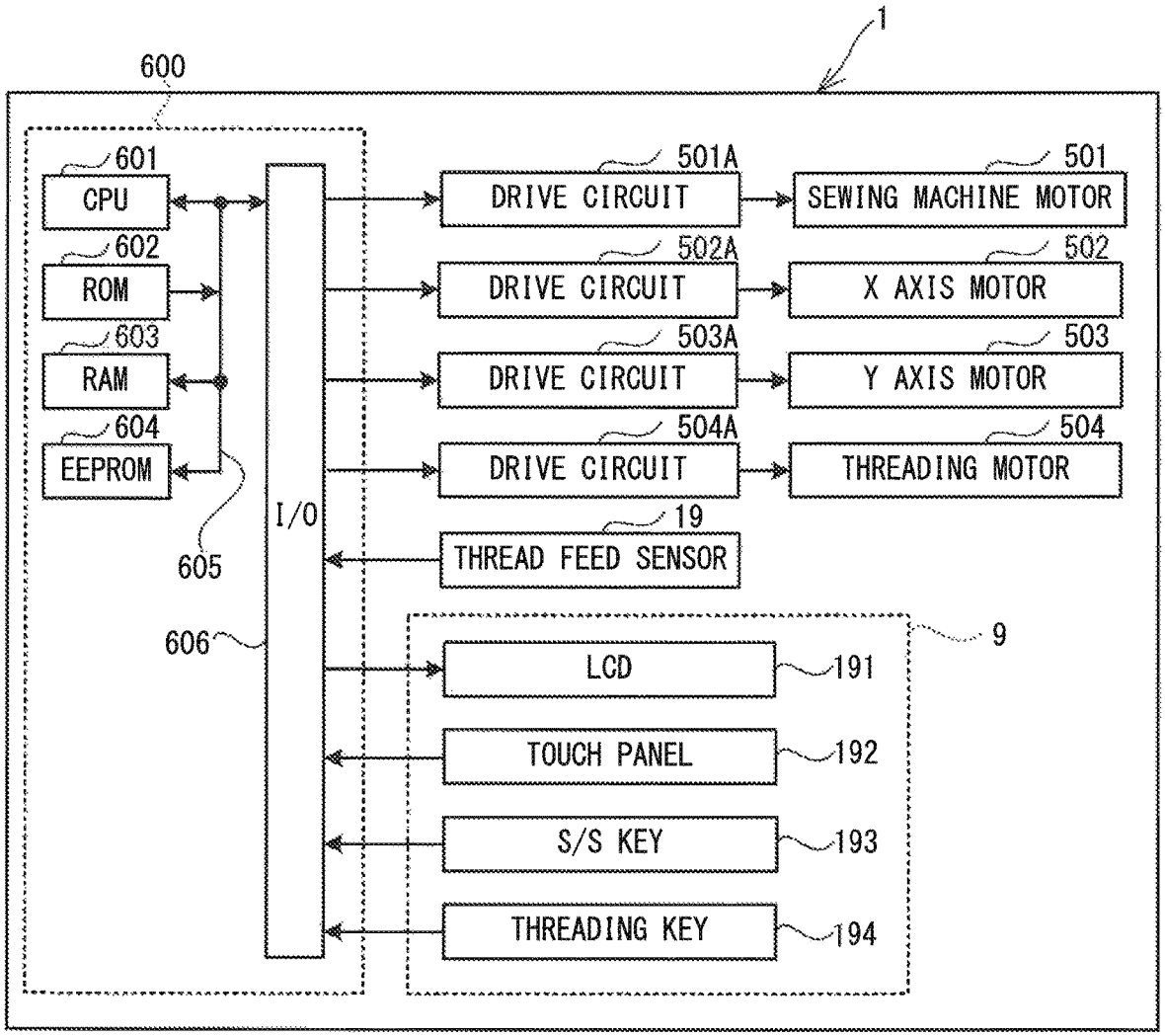
FIG. 9 is a block diagram showing an electrical configuration of the sewing machine 1.

The electrical configuration of the sewing machine 1 will be explained with reference to FIG. 9. The sewing machine 1 is provided with a control portion 600, drive circuits 501A to 504A, a sewing machine motor 501, the X axis motor 502, the Y axis motor 503, the threading motor 504, the thread feed sensor 19, the operation panel 9 and the like. The operation panel 9 includes the LCD 191, the touch panel 192, the S/S key 193, and the threading key 194. The control portion 600 is provided with a CPU 601, a ROM 602, a RAM 603, an EEPROM (registered trademark) 604, an input'output (I/O) interface 606, and the like, and these are connected to each other using a signal wire 605. The CPU 601 performs overall control of the sewing machine 1 and performs various arithmetic calculations and processing relating to sewing. Various programs, parameters and the like are stored in the ROM 602. A first predetermined amount and a second predetermined amount, which will be described later, are examples of the parameters stored in the RUM 602. Various pieces of information, such as calculation results of the arithmetic processing performed by the CPU 601, are stored in the RAM 603. Pattern data of embroidery patterns to be sewn, flag information that will be described later, and the like are stored in the EEPROM 604.

The drive circuits 501A to 504A, the thread feed sensor 19, the LCD 191, the touch panel 192, the S/S Key 193, and the threading key 194 are connected to the I/O interface 606. The drive circuit 501A drives the sewing machine motor 501 in accordance with a control signal from the control portion 600. The drive circuit 502A drives the X axis motor 502 in accordance with a control signal from the control portion 600. The drive circuit 503A drives the Y axis motor 503 in accordance with a control signal from the control portion 600. The drive circuit 504A drives the threading motor 504 in accordance with a control signal from the control portion 600.

In the sewing machine 1, when the sewing machine motor 501 is driven, a drive shaft (not shown in the drawings) rotates, and the needle bar 6 and the thread take-up lever 16 are driven up and down in synchronization with each other. Then, by the needle bar 6 and the thread take-up lever 16 working in concert with a rotating shuttle (not shown in the drawings) provided in the front end portion of the cylinder bed 7, stitches are formed on the work cloth held by the embroidery frame, for example, on top of the cylinder bed 7.

Main Processing

Main processing performed by the CPU 601 will be explained with reference to FIG. 10 and FIG. 11. When a power source of the sewing machine 1 is turned on, the CPU 601 reads out a main program from the ROM 602. On the basis of the read out main program, the CPU 601 starts the main processing. Immediately after the start of the main processing, the sewing machine motor 501 stops and the drive shaft, the needle bar 6, the thread take-up lever 16, and the rotating shuttle are in a state of not being driven. In other words, the sewing by the sewing machine 1 is in a state of being stopped. Note that it is assumed that the user has selected the operation mode (one of the embroidery sewing mode and the free motion mode), via the selection screen displayed on the operation panel 9, before the power source is turned on this time, namely when the power source was turned on in the past. Further, at the point of time of starting the main processing, it is assumed that flag information indicating the input operation mode is stored in the EEPROM 604.

Figure 10:
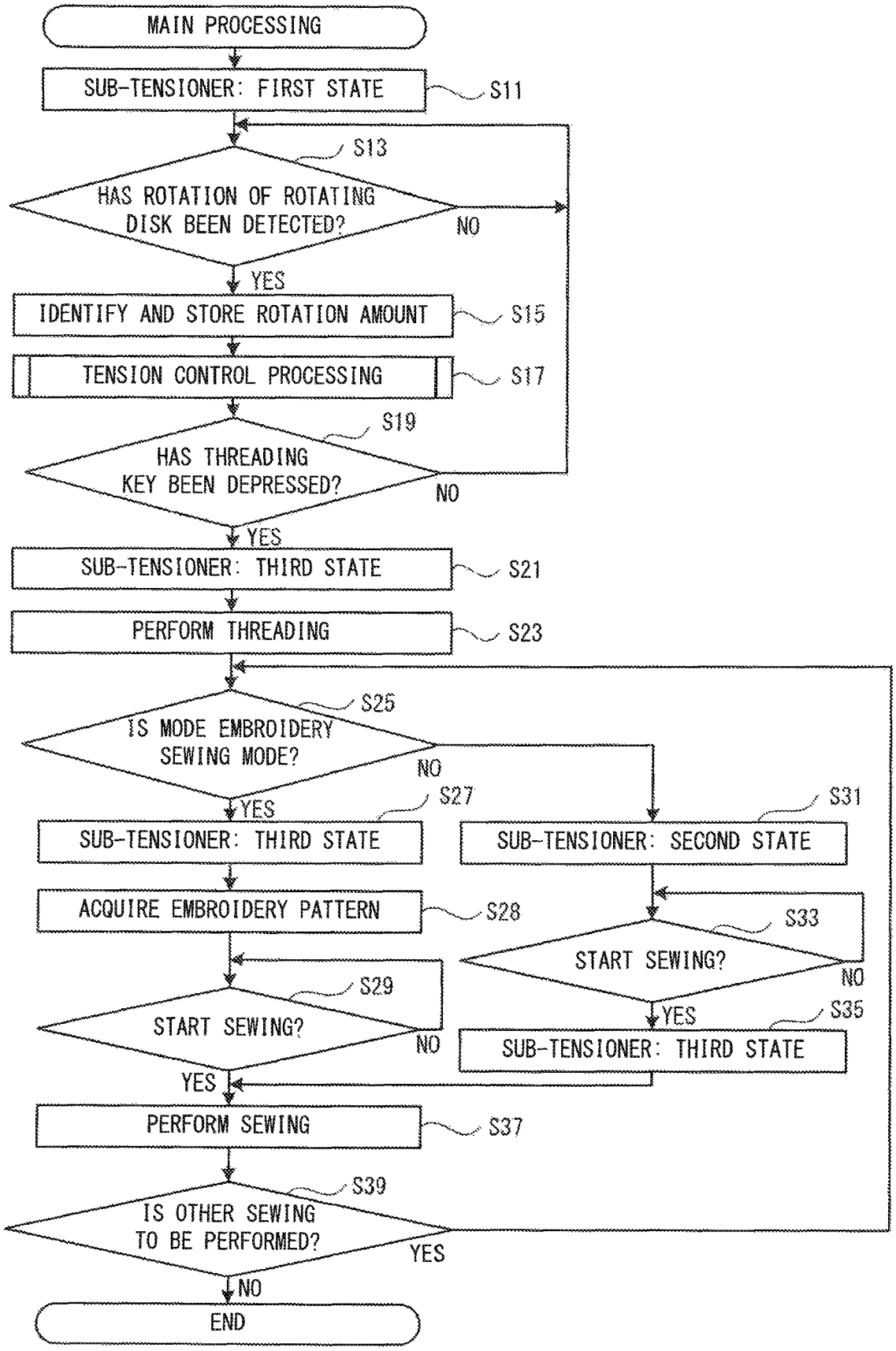
FIG. 10 is a flowchart of main processing.
Figure 11:
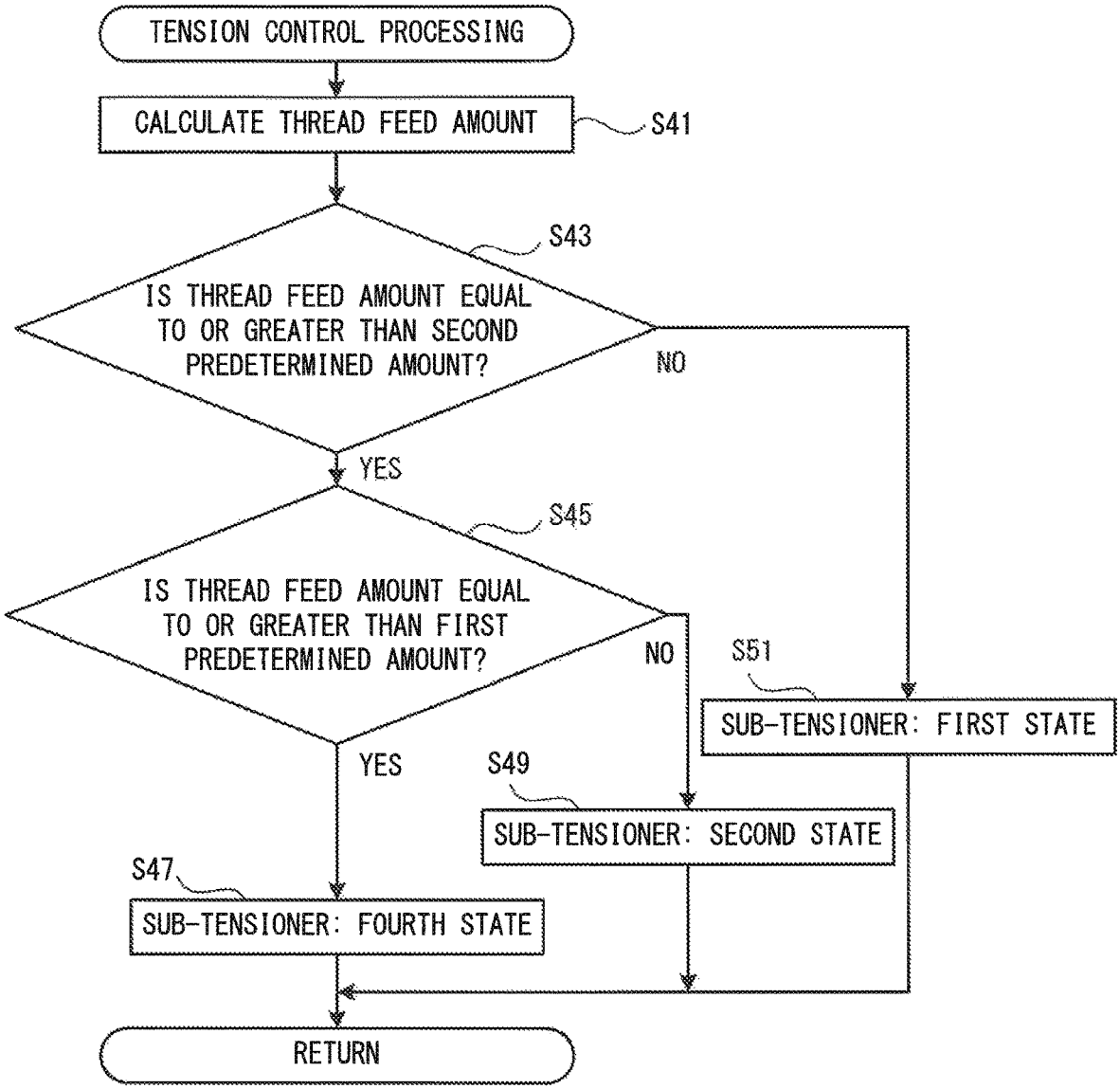
FIG. 11 is a flowchart of tension control processing.

As shown in FIG. 10, the CPU 601 drives the threading motor 504 by outputting the control signal to the drive circuit 504A, and moves the rack member 45 to the reference position P (refer to FIG. 2). The sub-tensioner 27 is thus in the first state (refer to FIG. 3) (step S11).

For example, the user feeds out the upper thread 12 from the thread spool 37 in the supply direction and inserts the upper thread 12 into the hole 35A of the guide bar 35. The user further feeds out the upper thread 12 in the supply direction. The upper thread 12 is disposed between the clamping portion 103 of the sub-tensioner 27 and the rear side support portion 75. In this state, the power source is turned on. By performing the processing at step S11, the upper thread 12 is clamped between the clamping portion 103 and the rear side support portion 75. Thus, in this state, for example, when the upper thread 12 is further fed out in the supply direction by the user, the first tension acts on the upper thread 12.

The CPU 601 determines whether the rotation of the rotating disk 82 of the main tensioner 26 has been detected via the thread feed sensor 19 (step S13). When the CPU 601 determines that the rotation of the rotating disk 82 has not been detected (no at step S13), the CPU 601 returns the processing to step S13. When the CPU 601 determines that the rotation of the rotating disk 82 has been detected (yes at step S13), the CPU 601 advances the processing to step S15.

The CPU 601 identifies, via the thread feed sensor 19, a rotation amount of the rotating disk 82. The CPU 601 stores the identified rotation amount in the RAM 603 (step S15). The CPU 601 performs tension control processing (refer to FIG. 11) (step S17).

For example, the user winds the upper thread 12, which has passed through the sub-tensioner 27, around the rotating disk 82 of the main tensioner 26 while feeding out the upper thread 12 in the supply direction. In the course of the upper thread 12 being wound around the rotating disk 82, the rotating disk 82 rotates. In this case, the rotation of the rotating disk 82 is detected by the thread feed sensor 19 (yes at step S13). In other words, the movement in the supply direction of the upper thread 12 is detected as a result of the rotation of the rotating disk 82. The rotation amount of the rotating disk 82 is identified via the thread feed sensor 19, and is stored in the RAM 603 (step S15).

The tension control processing will be explained with reference to FIG. 11. On the basis of the rotation amount stored in the RAM 603 by the processing at step S15 (refer to FIG. 10), the CPU 601 calculates a total amount of a movement amount in the supply direction of the upper thread 12 (hereinafter referred to as a "thread feed amount") from the start of the main processing (step S41). The CPU 601 determines whether the calculated total amount of the thread feed amount is equal to or greater than the second predetermined amount (step S43). When the CPU 601 determines that the total amount of the thread feed amount is smaller than the second predetermined amount (no at step S43), the CPU 601 advances the processing to step S51. The CPU 601 causes the rack member 45 to continue to be disposed in the reference position P (refer to FIG. 2) and maintains the sub-tensioner 27 in the first state (refer to FIG. 3) (step S51). The CPU 601 ends the tension control processing and returns the processing to the main processing (refer to FIG. 10). When the CPU 601 determines that the total amount of the thread feed amount is equal to or greater than the second predetermined amount (yes at step S43), the CPU 601 advances the processing to step S45.

The movement amount of the upper thread 12 when the rotating disk 82 has rotated once is set as the second predetermined amount, for example. In this case, while the upper thread 12 that has passed through the sub-tensioner 27 has not been wound once completely around the rotating disk 82, the rotation amount is smaller than the single rotation and it is thus determined that the total amount of the thread feed amount is smaller than the second predetermined amount (no at step S43). When the upper thread 12 that has passed through the sub-tensioner 27 has been wound once completely around the rotating disk 82, the rotation amount is greater than the single rotation, and it is thus determined that the total amount of the thread feed amount is equal to or greater than the second predetermined amount (yes at step S43).

In processing at step S45, the CPU 601 determines whether the total amount of the thread feed amount calculated by the processing at step S41 is equal to or greater than the first predetermined amount (step S45). The first predetermined amount is set as a value that is larger than the second predetermined amount. When the CPU 601 determines that the total amount of the thread feed amount is smaller than the first predetermined amount (no at step S45), the CPU 601 advances the processing to step S49. The CPU 601 drives the threading motor 504 by outputting a control signal to the drive circuit 504A, and moves the rack member 45 from the reference position P (refer to FIG. 2) to the upper position (refer to FIG. 7). The sub-tensioner 27 is thus in the second state (refer to FIG. 8) (step S49). The clamping portion 103 of the sub-tensioner 27 and the rear side support portion 75 are separated from each other, and the gap occurs therebetween. The CPU 601 ends the tension control processing and returns the processing to the main processing (refer to FIG. 10). When the CPU 601 determines that the total amount of the thread feed amount is equal to or greater than the first predetermined amount (yes at step S45), the CPU 601 advances the processing to step S47.

For example, after the upper thread 12 has been wound once around the rotating disk 82 by the user, when the upper thread 12 is further fed out in the supply direction while the sub-tensioner 27 is in the second state, the second tension that is smaller than the first tension acts on the upper thread 12. The second tension is substantially zero, and thus, the user can feed out the upper thread 12 in the supply direction with an extremely small amount of force. Further, the first predetermined amount is set, for example, as the movement amount of the upper thread 12 when the upper thread 12 has moved in the supply direction as far as the sub-tensioner 28, the thread take-up lever 16, and the guide hole 153 of the recessed portion 152, from the state of being wound around the rotating disk 82. In this case, while the upper thread 12 moves as fax as the guide hole 153 after the upper thread 12 has been wound around the rotating disk 82, it is determined that the total amount of the thread feed amount is smaller than the first predetermined amount (no at step S45), and the sub-tensioner 27 is thus in the second state (step S49). Therefore, for example, the force required for the user to move the upper thread 12, on which the second tension is acting, as far as the guide hole 153 is smaller than the force required while the user winds the upper thread 12, on which the first tension is acting, once around the rotating disk 82. After the upper thread 12 has been moved as far as the guide hole 153, the total amount of the thread feed amount is determined to be equal to or greater than the first predetermined amount (yes at step S45).

When the CPU 601 determines that the total amount of the thread feed amount is equal to or greater than the first predetermined amount (yes at step S45), the CPU 601 drives the threading motor 504 by outputting a control signal to the drive circuit 504A, and thus moves the rack member 45 from the upper position (refer to FIG. 7) to the first intermediate position. The sub-tensioner 27 is in the fourth state (step S47). In this case, the gap between the clamping portion 103 of the sub-tensioner 27 and the rear side support portion 75 is smaller than the gap when the sub-tensioner 27 is in the second state. The CPU 601 ends the tension control processing and returns the processing to the main processing (refer to FIG. 10).

For example, after the upper thread 12 has been moved as far as the guide hole 153 of the recessed portion 152 by the user, when the upper thread 12 is further fed out in the supply direction, the fourth tension, which is larger than the second tension and smaller than the first tension and the third tension, acts on the upper thread 12. Therefore, for example, over a length necessary to perform the threading processing to be described later, the force required for the user to feed out the upper thread 12, on which the fourth tension is acting, in the supply direction from the guide hole 153 is larger than the force required when the upper thread 12, on which the second tension is acting, is moved by the user as far as the guide hole 153 of the recessed portion 152. Thus, when the user hooks the upper thread 12 in order on the thread hook member 62 and the like, excessive feeding out of the upper thread 12 in the supply direction is suppressed.

As shown in FIG. 10, after the CPU 601 ends the tension control processing (step S17), the CPU 601 determines whether the depression of the threading key 194 has been detected (step S19). When the CPU 601 determines that the depression of the threading key 194 has not been detected (no at step S19), the CPU 601 returns the processing to step S13. When the CPU 601 determines that the depression of the threading key 194 has been detected (yes at step S19), the CPU 601 advances the processing to step S21. The CPU 601 drives the threading motor 504 by outputting a control signal to the drive circuit 504A, and moves the rack member 45 to the reference position P (refer to FIG. 2). As described above, in the present embodiment, the state of the sub-tensioner 27 when the sewing by the sewing machine 1 has been stopped is the same as the state of the sub-tensioner 27 when the sewing is being performed by the sewing machine 1. Namely, the first tension in the first state is the same as the third tension in the third state. Therefore, below, in a state after the threading key 194 has been depressed, the first state is rephrased as the third state and the first tension is rephrased as the third tension. The sub-tensioner 27 is in the third state (refer to FIG. 3) (step S21).

The CPU 601 performs the threading processing in the following manner (step S23). The CPU 601 drives the threading motor 504 by outputting a control signal to the drive circuit 504A, and thus moves the rack member 45 from the reference position P to the lower position (refer to FIG. 5 and FIG. 6). The threading hook 61 is inserted through the needle eye 8A (refer to FIG. 4) of the sewing needle 8. Note that, even when the rack member 45 is disposed in the lower position, the sub-tensioner 27 is maintained in the third state.

The user hooks the upper thread 12, which has been fed out from the guide hole 153 in the recessed portion 152, onto the thread hook member 62, the threading hook 61, the thread hook member 63 and the lower end portion of the thread holding plate 68 in that order. The user causes the upper thread 12 to be held by the clamping portion of the thread holding member 18 and cuts the upper thread 12 using the blade portion (not shown in the drawings). The sub-tensioner 27 is in the third state, and thus, the third tension acts on the upper thread 12 when the upper thread 12 is fed out in the supply direction. The third tension is larger than the second tension and the fourth tension.

The user once more depresses the threading key 194. The threading motor 504 is driven. The rack member 45 moves from the lower position to a position (hereinafter referred to as a "second intermediate position") between the lower position and the reference position P. The threading hook 61 moves to the rear. The thread loop is formed between the needle eye 8A and the threading hook 61. The thread loop is removed by the thread pulling member (not shown in the drawings). The upper thread 12 is in a state of being inserted through the needle eye 8A. The threading motor 504 is driven and the rack member 45 moves from the second intermediate position to the reference position P (refer to FIG. 2). The threading processing is ended. During the threading processing, the sub-tensioner 27 is maintained in the third state (refer to FIG. 3).

The CPU 601 reads out, from the EEPROM 604, the flag information indicating the operation mode. On the basis of the read out flag information, the CPU 601 determines which of the embroidery sewing mode and the free motion mode is the operation mode (step S25). When the CPU 601 determines that the operation mode is the embroidery sewing mode (yes at step S25), the CPU 601 advances the processing to step S27. The CPU 601 causes the rack member 45 to continue to be disposed in the reference position P (refer to FIG. 2). The sub-tensioner 27 is maintained in the third state (refer to FIG. 3) (step S27). When the upper thread 12 is fed out in the supply direction in this state, for example, the third tension acts on the upper thread 12.

The CPU 601 acquires an embroidery pattern selected by an operation by the user on the operation panel 9 (step S28). The CPU 601 determines whether the depression of the S/S key 193 has been detected (step S29). When the CPU 601 determines that the depression of the S/S key 193 has not been detected (no at step S29), the CPU 601 returns the processing to step S29. When the CPU 601 determines that the depression of the S/S key 193 has been detected (yes at step S29), the CPU 601 advances the processing to step S37. The CPU 601 drives the sewing machine motor 501 by outputting a control signal to the drive circuit 501A, and thus drives the drive shaft, the needle bar 6, the thread take-up lever 16, and the rotating shuttle. By the above-described processing, the sewing in the embroidery sewing mode is started, and the sewing of the embroidery pattern acquired by the processing at step S28 is performed (step S37). While the sewing is being performed, the sub-tensioner 27 is maintained in the third state, and the third tension continuously acts on the upper thread 12. The CPU 601 ends the main processing.

When the CPU 601 determines that the operation mode is the free motion mode (no at step S25), the CPU 601 advances the processing to step S31. The CPU 601 drives the threading motor 504 by outputting a control signal to the drive circuit 504A, and moves the rack member 45 from the reference position P (refer to FIG. 2) to the upper position (refer to FIG. 7). The sub-tensioner 27 changes from the third state (refer to FIG. 3) to the second state (refer to FIG. 8) (step S31). When the upper thread 12 is fed out in the supply direction in the state in which the rack member 45 has moved to the upper position, for example, the second tension acts on the upper thread 12.

The CPU 601 determines whether the depression of the S/S key 193 has been detected (step S33). When the CPU 601 determines that the depression of the S/S key 193 has not been detected (no at step S33), the CPU 601 returns the processing to step S33. When the CPU 601 determines that the depression of the S/S key 193 has been detected (yes at step S33), the CPU 601 advances the processing to step S35. The CPU 601 drives the threading motor 504 by outputting a control signal to the drive circuit 504A, and moves the rack member 45 from the upper position (refer to FIG. 7) to the reference position P (refer to FIG. 2). The sub-tensioner 27 changes from the second state (refer to FIG. 8) to the third state (refer to FIG. 3) (step S35). When the upper thread 12 is fed out in the supply direction in the state in which the rack member 45 has moved to the reference position P, for example, the third tension acts on the upper thread 12. The CPU 601 advances the processing to step S37. The CPU 601 drives the sewing machine motor 501 by outputting a control signal to the drive circuit 501A, and thus drives the drive shaft, the needle bar 6, the thread take-up lever 16, and the rotating shuttle. By the above-described processing, the sewing in the free motion mode is started (step S37).

When the sewing started at step S37 has ended, the CPU 601 determines whether a command to sew another embroidery pattern has been input by an operation by the user on the operation panel 9 (step S39). When the CPU 601 determines that the command to sew the other embroidery pattern has been input (yes at step S39), the CPU 601 advances the processing to step S25. When the CPU 601 determines that the command to sew the other embroidery pattern has not been input (no at step S39), the CPU 601 ends the main processing.

Main Operations and Effects of Present Embodiment

As described above, the CPU 601 of the sewing machine 1 causes the first tension to act on the upper thread 12 (step S11, step S51) while the movement of the upper thread 12 is detected while the sewing machine 1 is in the stopped state. The CPU 601 causes the third tension to act on the upper thread 12 (step S27, step S35) when the sewing is performed (step S37). When the CPU 601 has detected the movement of the upper thread 12 while the sewing machine 1 is in the stopped state (yes at step S13), the CPU 601 causes the second tension, or the fourth tension, which are smaller than the first tension and the third tension, to act on the upper thread 12 (step S47, step S49).

By the above-described processing, for example, from the single winding of the upper thread 12 on the rotating disk 82 by the user, the CPU 601 can reduce the tension acting on the upper thread 12 that is moved in the supply direction to the sub-tensioner 28, the thread take-up lever 16, and as far as the guide hole 153 of the recessed portion 152, in that order. More specifically, the above-described tension acting on the upper thread 12 can be made smaller than the tension acting on the upper thread 12 while the movement of the upper thread 12 is not detected when the sewing is stopped and the tension acting on the upper thread 12 while the sewing is being performed. Thus, the user can move the upper thread 12, on which the second tension or the fourth tension is acting, in the supply direction, with a weaker force than when moving the upper thread 12 on which the first tension or the third tension is acting. As a result, the sewing machine 1 can allow the user to easily perform the operation to move the upper thread 12 as far as the guide hole 153 and start the threading operation.

When the embroidery sewing mode is selected (yes at step S25) at a point in time at which the depression of the threading key 194 is detected (yes at step S19), there is a high possibility that the sewing will he continuously performed after the threading operation (step S23). Thus, after the threading operation, the CPU 601 sets the third tension as the tension acting on the upper thread 12 (step S27), thus obtaining a state in which the sewing can be immediately started. By the above-described processing, when the S/S key 193 has been depressed (yes at step S29) in order to start the sewing, for example, the sewing machine 1 can smoothly start the sewing in the embroidery sewing mode.

When the free motion mode is selected (no at step S25) at the point in time at which the depression of the threading key 194 is detected (yes at step S19), there is a low possibility that the sewing will be continuously performed after the threading operation (step S23). Thus, the CPU 601 temporarily sets the tension acting on the upper thread 12 to the second tension (step S31) after the threading operation. By the above-described processing, even after the threading operation, the sewing machine 1 can maintain the state in which the operation by the user to move the upper thread 12 is easily performed. Further, when the S/S key 193 has been depressed (yes at step S29) in order to start the sewing in this state, the CPU 601 can start the sewing in the free motion mode after returning the tension acting on the upper thread 12 to the third tension.

The sewing machine 1 has the rack member 45 that can move between the upper position and the lower position. When the rack member 45 has moved to the upper position (refer to FIG. 7), the sub-tensioner 27 is in the second state (step S31, step S49). The CPU 601 causes the second tension to act on the upper thread 12 by moving the rack member 45 to the upper position. When the rack member 45 has moved to the lower position (refer to FIG. 5), the sub-tensioner 27 is in the third state (step S21). By moving the rack member 45 to the lower position, the CPU 601 causes the threading operation to be performed by the threading mechanism 120 while the third tension is caused to act on the upper thread 12.

As described above, by moving the rack member 45 in the up-down direction using the same threading motor 504 that is a common drive source of the threading mechanism 120 and the adjustment mechanism 130, the sewing machine 1 can link the threading operation by the threading mechanism 120 with the operation by the sub-tensioner 27 that causes the third tension to act on the upper thread 12. Further, there is not overlap between the state in which the threading operation is performed by the threading mechanism 120, and the state in which the second tension is caused to act on the upper thread 12 by the sub-tensioner 27. Thus, the threading mechanism 120 and the sub-tensioner 27 can be operated at respective timings. In addition, when the threading operation is performed by the threading mechanism 120, the third tension is caused to constantly act on the upper thread 12 by the sub-tensioner 27, and the second tension does not act on the upper thread 12. As a result, the sewing machine 1 can cause the tension to act appropriately on the upper thread 12 at the time of the threading operation by the threading mechanism 120, and can thus appropriately perform the threading operation.

When the movement of the upper thread 12 is detected while the sewing is stopped (yes at step S13), the CPU 601 compares the total amount of the thread feed amount with the second predetermined amount (step S43). The CPU 601 sets the tension of the upper thread 12 as the relatively large first tension (step S51) until the total amount of the thread feed amount reaches the second predetermined amount (no at step S43). After the total amount of the thread feed amount is equal to or greater than the second predetermined amount (yes at step S43), the CPU 601 sets the tension of the upper thread 12 to the relatively small second tension (step S49). As a result, the sewing machine 1 can cause the first tension to act on the upper thread 12 until the upper thread 12 is wound around the rotating disk 82. Thus, the user can easily perform the operation to wind the upper thread 12 around the rotating disk 82.

When the movement of the upper thread 12 is detected while the sewing is stopped (yes at step S13), the CPU 601 compares the total amount of the detected thread feed amount with the first predetermined amount (step S45). The CPU 601 sets the tension of the upper thread 12 to the relatively small second tension (step S49) until the total amount of the thread feed amount reaches the first predetermined amount (no at step S45). By the above-described processing, the sewing machine 1 can allow the user to easily perform the operation of moving the upper thread 12 in the supply direction from the state in which the upper thread 12 has been wound around the rotating disk 82 by the user, to the sub-tensioner 28, the thread take-up lever 16, and the guide hole 153 of the recessed portion 152, in that order. Further, after the total amount of the thread feed amount is equal to or greater than the first predetermined amount (yes at step S45), the CPU 601 sets the tension of the upper thread 12 to the relatively large fourth tension (step S47). As a result, before starting the threading operation, the user can perform the operation of hooking the upper thread 12 onto the thread hook member 62, the threading hook 61, the thread hook member 63 and the lower end portion of the thread holding plate 68 in that order, in the state in which the appropriate tension is acting on the upper thread 12. Thus, the user can easily perform the above-described operations.

The sub-tensioner 27 is provided with the clamping portion 103 and the rear side support portion 75. When the sub-tensioner 27 is in the first state or the third state, the clamping portion 103 and the rear side support portion 75 are in contact with each other when the upper thread 12 is not interposed therebetween. When the sub-tensioner 27 is in the second state, the clamping portion 103 and the rear side support portion 75 are separated from each other when the upper thread 12 is not interposed therebetween. In this way, by causing the clamping portion 103 and the rear side support portion 75 to switch between the state of being in contact with each other and the state of being separated from each other, the sewing machine 1 can easily switch the tension acting on the upper thread 12 between the first tension or the third tension and the second tension. Further, by adjusting the degree of separation between the clamping portion 103 and the rear side support portion 75, the sewing machine 1 can easily adjust the tension acting on the upper thread 12.

Modified Examples

The present disclosure is not limited to the above-described embodiment, and various changes are possible. In the above-described embodiment, the first state and the third state are exemplified as being the same state of the sub-tensioner 27. Thus, the first tension that acts on the upper thread 12 when the sub-tensioner 27 is in the first state, and the third tension that acts on the upper thread 12 when the sub-tensioner 27 is in the third state are the same as each other. However, the first state and the third state of the sub-tensioner 27 may be different from each other. The first tension and the third tension may be different from each other within a range that satisfies the condition of being larger than the second tension. Further, in the above description, the second tension that acts on the upper thread 12 when the sub-tensioner 27 is in the second state is smaller than the third tension. However, the second state of the sub-tensioner 27 may be adjusted such that the second tension and the third tension are the same as each other.

In the above-described embodiment, when the sub-tensioner 27 is in the second state, the clamping portion 103 and the rear side support portion 75 are separated from each other and the second tension acting on the upper thread 12 is substantially zero. However, when the sub-tensioner 27 is in the second state, the damping portion 103 and the rear side support portion 75 may be in contact with each other in a state in which the upper thread 12 is not interposed therebetween. The second tension may be larger than substantially zero. In the above-described embodiment, when the CPU 601 detects the depression of the the threading key 194 (yes at step S19), the CPU 601 moves the rack member 45 to the reference position P and sets the sub-tensioner 27 in the third state (step S21). However, the CPU 601 may also set the sub-tensioner 27 in the third state when a condition other than the depression of the threading key 194 is satisfied. For example, the CPU 601 may set the sub-tensioner 27 in the third state after a predetermined period of time has elapsed from when the tension control processing (step S17) is performed.

In the above-described embodiment, when the CPU 601 determines that the operation mode is the embroidery sewing mode (yes at step S25), the CPU 601 maintains the sub-tensioner 27 in the third state (step S27). However, when the CPU 601 determines that the operation mode is the embroidery sewing mode, the CPU 601 may temporarily change the sub-tensioner 27 from the third state to the second state and cause the second tension to act on the upper thread 12. The CPU 601 may return the sub-tensioner 27 from the second state to the third state when the CPU 601 detects the depression of the S/S key 193 (yes at step S29), and may cause the third tension to act on the upper thread 12.

In the above-described embodiment, when the CPU 601 determines that the operation mode is the free motion mode (no at step S25), the CPU 601 temporarily changes the sub-tensioner 27 from the third state to the second state (step S31). However, when the CPU 601 determines that the operation mode is the free motion mode, the CPU 601 may maintain the sub-tensioner 27 in the third state and cause the third tension to act on the upper thread 12. In the above-described embodiment, the sewing machine 1 can operate in either of the operation modes, namely, the embroidery sewing mode or the free motion mode. However, the sewing machine 1 may he capable of operating in only one of the operation modes, namely, the embroidery sewing mode or the free motion mode.

In the above-described embodiment, the sewing machine 1 causes the state of the sub-tensioner 27 to be the second state by moving the rack member 45 to the upper position that is higher than the reference position P. Further, the sewing machine 1 causes the state of the sub-tensioner 27 to be the fourth state by moving the rack member 45 to the first intermediate position. In addition, the sewing machine 1 causes the state of the sub-tensioner 27 to be the first state or the third state by moving the rack member 45 to the reference position P and to a position (including the lower position and the second intermediate position) that is lower than the reference position P. However, the sewing machine 1 may switch the state of the sub-tensioner 27 using a member different to the rack member 45. For example, the sewing machine 1 may drive the threading mechanism 120 and the sub-tensioner 27 using separate motors.

In the above-described embodiment, the CPU 601 detects the rotation amount of the rotating disk 82 using the thread feed sensor 19 (step S13), and calculates the total amount of the thread feed amount on the basis of that rotation amount (step S41). However, the CPU 601 may identify the total amount of the thread feed amount using another method. For example, the sewing machine 1 may be provided with a sensor capable of detecting a rotation amount of the thread spool 37. The CPU 601 may calculate the total amount of the thread feed amount on the basis of the rotation amount detected by that sensor. In the above-described embodiment, when the total amount of the thread feed amount is equal to or greater than the second predetermined amount and is smaller than the first predetermined amount (yes at step S43; no at step S45), the CPU 601 sets the sub-tensioner 27 to the second state. When the total amount of the thread feed amount is equal to or greater than the first predetermined amount (yes at step S43; yes at step S45), the CPU 601 sets the sub-tensioner 27 to the fourth state. However, the CPU 601 may cause the second tension to act on the upper thread 12 by setting the sub-tensioner 27 to the second state when the total amount of the thread feed amount is equal to or greater than the second predetermined amount.

In the above-described embodiment, when the total amount of the thread feed amount is smaller than the second predetermined amount (no at step S43), the CPU 601 sets the sub-tensioner 27 to the first state and causes the first tension to act on the upper thread 12. However, the CPU 601 may set the sub-tensioner 27 to the second state when the total amount of the thread feed amount is smaller than the second predetermined amount.

In the above-described embodiment, the sewing machine 1 adjusts the tension acting on the upper thread 12 when the upper thread 12 is fed out in the supply direction, by adjusting the gap between the clamping portion 103 of the sub-tensioner 27 and the rear side support portion 75. However, the sewing machine 1 may adjust the tension acting on the upper thread 12 by a different method to that described above. For example, the sewing machine 1 may adjust the tension acting on the upper thread 12 by adjusting a rotation torque of the thread spool 37 or of the rotating disk 82.

What is claimed is:

1. A sewing machine comprising:

a thread tension mechanism configured to cause a tension to act on an upper thread;

a thread feed sensor configured to detect a movement of the upper thread;

a sewing portion configured to perform sewing using a sewing needle;

a processor; and a memory configured to store computer-readable instructions, when executed by the processor, perform processes comprising:

causing a first tension to act on the upper thread by causing the thread tension mechanism to be in a first state, in a sewing stopped state in which the sewing by the sewing portion is stopped;

causing a second tension to act on the upper thread, by causing the thread tension mechanism to be in a second state, when the movement of the upper thread is detected by the thread feed sensor, the second tension being smaller than the first tension; and causing a third tension to act on the upper thread by causing the thread tension mechanism to be in a third state, in a sewing state in which the sewing by the sewing portion is performed, the third tension being equal to or greater than the second tension.

2. The sewing machine according to claim 1, further comprising:

a threading mechanism configured to pass the upper thread through a needle eye of the sewing needle, using a threading hook; and a reception portion configured to receive a command to pass the upper thread through the needle eye using the threading mechanism, wherein the computer-readable instructions further perform processes comprising:

causing the third tension to act on the upper thread by causing the thread tension mechanism to be in the third state, when the command is received by the reception portion, in the sewing stopped state.

3. The sewing machine according to claim 2, further comprising:

a movement member configured to drive the threading mechanism, the movement member being movable between a first position and a second position different to the first position, wherein the computer-readable instructions further perform processes comprising:

causing the second tension to act on the upper thread by causing the thread tension mechanism to be in the second state when the movement member has moved to the first position, and causing the third tension to act on the upper thread by causing the thread tension mechanism to be in the third state and driving the threading mechanism when the movement member has moved to the second position.

4. The sewing machine according to claim 1, wherein an operation mode of the sewing machine is selectable between a first mode and a second mode, the first mode being a mode in which embroidery sewing is performed while automatically moving an embroidery frame that holds a work cloth, and the second mode being a mode in which embroidery sewing is performed while a user manually moves the work cloth, and the computer-readable instructions further perform processes comprising:

causing the third tension to act on the upper thread by causing the thread tension mechanism to be in the third state when the operation mode is the first mode, and causing the second tension to act on the upper thread by causing the thread tension mechanism to be in the second state when the operation mode is the second mode.

5. The sewing machine according to claim 1, wherein the thread feed sensor detects a movement amount of the upper thread, and the computer-readable instructions further perform processes comprising:

when the thread feed sensor detects the movement of the upper thread in the sewing stopped state, causing the second tension to act on the upper thread by causing the thread tension mechanism to be in the second state when a total amount of the detected movement amount is smaller than a first predetermined amount, and causing a fourth tension to act on the upper thread by causing the thread tension mechanism to be in a fourth state when the total amount of the detected movement amount is equal to or greater than the first predetermined amount, the fourth tension being larger than the second tension and being smaller than the third tension.

6. The sewing machine according to claim 5, wherein the computer-readable instructions further instruct the processor to perform a process comprising:

when the thread feed sensor detects the movement of the upper thread in the sewing stopped state, causing the first tension to act on the upper thread by causing the thread tension mechanism to be in the first state, when the total amount of the detected movement amount is smaller than a second predetermined amount, the second predetermined amount being smaller than the first predetermined amount.

7. The sewing machine according to claim 1, wherein the thread tension mechanism includes two clamping portions that are disposed facing each other and that clamp the upper thread, the two clamping portions are in contact with each other in the first state and the third state, and the two clamping portions are separated from each other in the second state.

* * * * *